US009179771B2

(12) United States Patent
Haemmerle et al.

(10) Patent No.: US 9,179,771 B2
(45) **Date of Patent: *Nov. 10, 2015**

(54) COUPLING DEVICE FOR DRAWERS

(71) Applicant: Julius Blum GmbH, Hochst (AT)

(72) Inventors: Kurt Haemmerle, Lustenau (AT); Andreas Holzer, Dornbirn (AT)

(73) Assignee: JULIUS BLUM GMBH, Hochst (AT)

( * ) Notice: Subject to any disclaimer, the term of this patent is extended or adjusted under 35 U.S.C. 154(b) by 0 days.

This patent is subject to a terminal disclaimer.

(21) Appl. No.: 13/934,754

(22) Filed: Jul. 3, 2013

(65) Prior Publication Data

US 2013/0293077 A1 Nov. 7, 2013

(30) Foreign Application Priority Data

Jan. 5, 2011 (AT) ..... A 17/2011
May 20, 2011 (AT) ..... A 731/2011

(51) Int. Cl.
*A47B 88/00* (2006.01)
*A47B 88/04* (2006.01)

(52) U.S. Cl.
CPC ..... *A47B 88/0085* (2013.01); *A47B 88/04* (2013.01); *A47B 88/0422* (2013.01)

(58) Field of Classification Search
CPC ..... A47B 88/0085; A47B 88/0422
USPC ..... 312/330.1, 334.1, 334.4–334.6, 312/348.1–348.2
See application file for complete search history.

(56) References Cited

U.S. PATENT DOCUMENTS

2004/0239219 A1 12/2004 Kim et al.
2007/0138924 A1 * 6/2007 Lautenschlager ..... 312/348.2
(Continued)

FOREIGN PATENT DOCUMENTS

AT 509 414 4/2013
CN 101528083 9/2009
(Continued)

OTHER PUBLICATIONS

Austrian Search Report completed Mar. 21, 2013 in Application No. 731/2011, with partial English translation thereof.
(Continued)

*Primary Examiner* — Matthew Ing
(74) *Attorney, Agent, or Firm* — Wenderoth, Lind & Ponack, L.L.P.

(57) ABSTRACT

A coupling device for removably coupling a drawer to an extendable rail of a pull-out guide includes an adjusting device, by which a position of a drawer that is connected to the rail can be adjusted relative to the rail in the lateral direction and/or in the longitudinal direction (L) of the pull-out guide. The coupling device has a fixing part to be fixed to the drawer, and a coupling part to be coupled to the rail. The fixing part can be moved relative to the coupling part by the adjusting device in a linear manner. The adjusting device has an adjusting wheel rotatably mounted on the coupling part or on the fixing part. An actuating region is provided on the adjusting wheel in order to rotate the adjusting wheel, and the adjusting device includes a transmission device. A movement of the actuating region of the adjusting wheel can be converted by the transmission device into a linear movement of the fixing part relative to the coupling part such that the position of the drawer is adjusted relative to the furniture body in the same direction in which the actuating region is moved.

32 Claims, 18 Drawing Sheets

(56) References Cited

U.S. PATENT DOCUMENTS

| | | | | |
|---|---|---|---|---|
| 2009/0236959 | A1 | 9/2009 | Liang et al. | |
| 2009/0251037 | A1 * | 10/2009 | Berger | 312/334.1 |
| 2012/0292465 | A1 | 11/2012 | Holzer et al. | |
| 2012/0311818 | A1 | 12/2012 | Grabher | |

FOREIGN PATENT DOCUMENTS

| | | | |
|---|---|---|---|
| CN | 101842034 | | 9/2010 |
| DE | 296 00 180 | | 2/1996 |
| DE | 20 2007 014 954 | | 1/2009 |
| DE | 20 2009 017 319 | | 6/2011 |
| EP | 1 649 782 | | 4/2006 |
| WO | 2009/056326 | | 5/2009 |
| WO | WO2009080403 | * | 7/2009 |
| WO | 2011/094776 | | 8/2011 |

OTHER PUBLICATIONS

Chinese Search Report (SR) issued Nov. 15, 2014 in Chinese Patent Application No. 201180064225.8.

* cited by examiner

COUPLING DEVICE FOR DRAWERS

BACKGROUND OF THE INVENTION

The invention concerns a device for releasably coupling a drawer to an extendable rail of an extension guide having the features of a classifying portion.

A coupling device for drawers is disclosed in Austrian patent application A 144/2010. By means of the device, it is possible firstly for the drawer which is pushed on to the extension guide to be connected to an extendable rail of the extension guide, wherein abutment surfaces are arranged in the connecting region for making that connection. Due to the abutment surfaces, automatic latching of the drawer to the rail of the extension guide can take place, and a release portion allows the drawer to be released from the rail again.

By virtue of the fact that the above-mentioned device has a fixing portion and a coupling portion, the relative position of which is adjustable to each other by an adjusting device, it is possible to compensate for minor inaccuracies in manufacture of the extension guide or the device or an inaccuracy in mounting in or on a furniture carcass, which have the result that the drawer cannot be pulled out as desired in the longitudinal direction, but slightly inclined relative thereto. Particularly when a plurality of drawers are arranged in a furniture carcass, such a device makes it possible to provide a cleaner front appearance for the furniture carcass in regard to the lateral alignment of the drawers.

In that case, the adjusting device has an adjusting wheel, wherein the fixing portion and the coupling portion of the device can be displaced relative to each other by rotation of the adjusting wheel. The device itself should involve extremely compact overall dimensions in order that it can be fitted at the underside of the drawer bottom without impeding mounting and mobility of a drawer arranged therebeneath. For that reason, the components of the device and in particular the adjusting device are filigree delicate components. In that arrangement, the adjusting wheel is mounted rotatably about an axis arranged vertically in the mounted position. The adjusting wheel has an external tooth arrangement representing an actuating region which is accessible by way of an opening in the housing of the device.

The housing is arranged in opposite relationship to the side wall so that the actuating region, upon rotation of the adjusting wheel, is rotated substantially parallel to or in anti-parallel relationship with the extension direction of the drawer. The movement of the drawer relative to the extension rail, caused by the rotation of the adjusting wheel, is effective however in a lateral direction. For a person who adjusts the position of the drawer with the adjusting wheel, it is therefore not immediately apparent in what direction that person has to rotate the adjusting wheel in order to displace the drawer relative to the extension rail in a desired direction. If in contrast there is a wish to make the entire external region of the adjusting wheel available at the same time as the actuating region, then the entire adjusting wheel must be freely accessible and for that purpose must be fitted on to the device by virtue of the rotation about an axis that is vertical in the mounted condition. That construction has the disadvantage of involving a large structural height, which in turn is harmful in terms of the space requirement involved. In addition an exposed adjusting wheel of that kind entails the risk of damage or injury in particular because of the filigree components.

SUMMARY OF THE INVENTION

Therefore, the object of the invention is to avoid the foregoing disadvantages and to provide a device for releasably coupling a drawer to an extension guide, which improves the handlability of the above-mentioned device and with which the position of the drawer relative to the extension guide can be intuitively adjusted.

The device according to the invention for releasably coupling a drawer to an extendable rail of an extension guide permits mounting or dismantling of the drawer in its entirety to and from the extension guide, in the simple fashion referred to in the opening part of this specification.

To alter the position of a drawer connected to the rail relative to the rail in a lateral direction, for example to correct the join appearance of a drawer arranged in a furniture carcass, the releasable coupling device has a fixing portion which can be fixed to the drawer and a coupling portion which can be coupled to the rail. The coupling portion and the fixing portion are linearly movable relative to each other so that the position of the fixing portion and the coupling portion is adjustable relative to each other by way of an adjusting device provided in the releasable coupling device. The adjusting device has an adjusting wheel mounted on the coupling portion or the fixing portion rotatably about an axis.

In addition or alternatively, the adjusting device can be adapted for adjustment of the position of the drawer connected to the rail in the longitudinal direction of the extension guide as in the closed end position, the so-called closed position or closure position, the drawer can retract excessively far into the furniture carcass or can project excessively far from the furniture carcass, thereby also resulting in an untidy join appearance which can be corrected with the adjusting device according to the invention. Such adjustment in the longitudinal direction of the extension guide is also referred to as depth adjustment and is advantageous in particular in the case of so-called internal extension means.

In the mounted condition in which the drawer is connected to the rail of an extension guide the coupling portion of the device provides for connecting the drawer to the rail, by the fixing portion of the device being fixed to the drawer and the coupling portion being releasably connected to the rail. The adjustability according to the invention of the relative positions of the fixing portion and the coupling portion relative to each other means that the position of the drawer connected to the rail can be adjusted relative to the rail in a lateral direction, in which respect lateral direction in the mounted condition relates to a horizontal direction transversely to the longitudinal direction in which the drawer can be pulled out.

In addition or alternatively, the position of the drawer connected to the rail can be adjusted in the longitudinal direction relative to the furniture carcass by virtue of the adjustability of the relative positions of the fixing portion and the coupling portion relative to each other in the longitudinal direction of the extension guide.

The displacement of the fixing portion relative to the coupling portion only has an effect on the closed position of the drawer, in particular in respect of depth adjustment of the drawer. A movement of the fixing portion relative to the coupling portion causes adjustment of the closed position of the drawer in that case.

In that respect, the fixing portion and the coupling portion can be guided displaceably on each other, for example by abutment surfaces of a suitable configuration, thereby to ensure that the positional displacement actually takes place in a lateral direction or in a longitudinal direction.

Furthermore, the fixing portion and the coupling portion respectively include a mounting plate. The mounting plate of the fixing portion has fixing devices, for example drilled holes for screws, by means of which the fixing portion can be fixed to the drawer. The coupling element itself, which in the mounted condition is in engagement with the rail of the extension guide, is mounted to the mounting plate of the coupling portion. For relative positional adjustment of the fixing portion and the coupling portion relative to each other, it can be provided that the adjusting device displaces the positions of the mounting plates of the fixing portion and the mounting plate of the coupling portion relative to each other in the lateral direction or in the longitudinal direction.

The extension guide can have a carcass rail and a drawer rail, the carcass rail being mounted to a furniture carcass while the drawer rail can be pulled out along the carcass rail. For fitting the drawer in the furniture carcass, the drawer is releasably coupled to the drawer rail by way of the device according to the invention.

Arranged between the carcass rail and the drawer rail can be a central rail, permitting full extension of the drawer.

By virtue of the rotatable mounting of the adjusting wheel about an axis arranged in the mounting position substantially parallel to the drawer extension direction, that is to say relative to the longitudinal direction of the extendable rail, or about an axis which is arranged perpendicularly thereto but also horizontally, that is to say in the lateral direction, it is firstly possible to comply with the requirements of a small structural height for the device. If the device is mounted to the underside of the drawer, that is to say to the drawer bottom, the adjusting wheel can have an actuating region arranged at the underside of the device. That actuating region with which the adjusting wheel can be turned is afforded for example by a roughened peripheral surface on the adjusting wheel or an external tooth arrangement. In that respect, the actuating region is generally that region of the adjusting wheel which at the moment of actuation is at the greatest distance from the drawer bottom.

The actuating region of an adjusting wheel which in the mounted position is mounted rotatably about an axis arranged in the longitudinal direction of the drawer or the extendable rail or about an axis arranged perpendicularly thereto and horizontally, can be arranged in the region of the lowest point of the adjusting wheel, for example in that region which is furthest remote from the drawer bottom, and upon rotation is moved in a lateral direction or in the longitudinal direction. Therefore, upon rotation about an axis arranged in the longitudinal direction, the actuating region which is afforded by the point of the adjusting wheel, that is lowest at the respective moment in time, during the rotation of the adjusting wheel, involves a speed vector which is oriented substantially in a lateral direction, that is to say in parallel or anti-parallel relationship with the front panel.

In comparison, upon rotation about an axis which is arranged in the lateral direction and which is therefore horizontal and perpendicular to the longitudinal direction, the actuating region, during rotation of the adjusting wheel, involves a speed vector which is oriented substantially in the longitudinal direction, that is to say in parallel or anti-parallel relationship with the longitudinal direction of the extension rail or the extension guide.

Because the adjusting device includes a transmission device which converts the movement of the actuating region provided for rotation of the adjusting wheel, by the adjusting device, into a linear movement of the fixing portion relative to the coupling portion, in such a way that the position of the drawer is adjusted relative to the furniture carcass in the same direction in which the actuating region is moved upon rotation of the adjusting wheel, an intuitive adjusting device for lateral adjustment and/or adjustment in the longitudinal direction of the drawer relative to the extension guide can be achieved.

Adjustment of the position of the drawer relative to the furniture carcass and the actuating region of the adjusting wheel thus involve parallel speed vectors.

In principle, the adjusting wheel is actuable in both directions and thereby permits adjustment of the drawer in both directions thereof. If the direction of rotation of the adjusting wheel is reversed and therefore the direction of movement of the actuating region is altered, the fixing portion also moves in the opposite direction relative to the coupling portion. That also adjusts the position of the drawer relative to the furniture carcass in the opposite direction.

The fixing portion is fixedly connected to the drawer while the coupling portion is connected in coupled relationship to the extendable rail. Therefore, upon a movement of the actuating region in the direction of the extendable rail, the drawer is also in that direction as the transmission device provides that the fixing portion is moved relative to the coupling portion in the same direction as the actuating region of the adjusting wheel. Upon a movement of the actuating region in a direction facing away from the extendable rail, the drawer also moves away from the extendable rail.

As a result, upon lateral adjustment, the adjusting wheel is automatically rotated in the correct direction. If there is a wish to move the drawer towards the right relative to the rail, that is to say relative to the furniture carcass, the adjusting wheel is turned towards the right. If the wish is for displacement of the drawer towards the left then the adjusting wheel is rotated towards the left.

The same applies if the adjusting device is adapted for adjustment in the longitudinal direction. For adjustment in the longitudinal direction the adjusting wheel is automatically rotated in the correct direction. If there is a wish to move the position of the drawer inwardly with respect to the furniture carcass, in particular in the closed position of the drawer, then the adjusting wheel is rotated inwardly in the actuating region. If the wish is for adjustment of the position of the drawer to be effected outwardly, then the adjusting wheel is rotated outwardly at the actuating region.

In principle various known devices can be used for the transmission device, for the conversion of movements, in particular simple transmission arrangements or transmission elements.

In an embodiment of the invention a movement of the actuating region of the adjusting wheel is converted by the transmission device into a linear movement of the fixing portion relative to the coupling portion in the same direction as the direction of movement of the actuating region. In this case, a movement of the fixing portion acts directly on a movement of the drawer relative to the furniture carcass. If the element moved by the adjusting device is connected directly to the drawer then conversion of the movement of the actuating region into a linear movement of the fixing portion causes positional displacement of the drawer relative to the coupling portion or relative to the furniture carcass connected thereto by way of the extension guide, in the same direction.

In an embodiment of the invention, an abutment or holding element at least in the closed position of the drawer is operatively connected to the extension guide or the furniture carcass. For example, the abutment or holding element is arranged on the fixing portion or the coupling portion and in the closed position of the drawer is supported against the furniture carcass or the extension guide, preferably the carcass rail. In that case, the abutment or holding element is movable linearly by the adjusting device. If for example the abutment or holding element is displaced in the longitudinal direction of the extension guide by way of the adjusting device and the drawer in the closed end position bears against the abutment or holding element then the position of such support and therewith also the position of the drawer which is in the closed end position is altered by virtue of a movement of the abutment or holding element.

The transmission device in that case can be of such a configuration that a movement of the actuating region of the adjusting wheel can be converted into a linear movement of the abutment or holding element in the same direction or a direction opposite thereto, with the proviso that the position of the drawer relative to the furniture carcass is displaced in the same direction as the actuating region, at least in the closed end position.

In an embodiment in that case the abutment or holding element is mounted to the fixing portion and is moved by the adjusting device relative to the fixing portion. In that case, the relative movement according to the invention of the fixing portion with respect to the coupling portion is effected by the relative movement of the abutment or holding element relative to the fixing portion and thus also the coupling portion.

If the adjusting device is adapted to adjust the position of a drawer connected to the rail relative to the rail both in the lateral direction and also in the longitudinal direction of the extension guide, the adjusting device has a first adjusting wheel and a second adjusting wheel. Positional adjustment is effected in the lateral direction by means of the first adjusting wheel, and positional adjustment is effected in the longitudinal direction of the extension guide, that is to say in the extension direction, with the second adjusting wheel. In that case the first adjusting wheel is rotatable about an axis which in the mounted position is arranged substantially parallel to the drawer extension direction. The second adjusting wheel is rotatable about an axis which in the mounted position is arranged substantially horizontally and perpendicularly to the extension direction of the drawer, that is to say in a lateral direction. The first and second adjusting wheels can have transmission devices which are separate from each other and which act independently. It is however also possible to provide a common transmission device which converts both the movement of the first adjusting wheel and also the movement of the second adjusting wheel into corresponding linear movements of the fixing portion relative to the coupling portion.

Insofar as an embodiment provides that the adjusting device has at least two axially spacedly arranged devices for converting a rotary movement of the adjusting wheel into a linear movement of the fixing portion relative to the coupling portion, the force afforded by rotation of the adjusting wheel is passed to the fixing portion of a coupling portion by way of two axially spaced devices. In that respect, it can be the adjusting wheel is rotatably mounted to the coupling portion and the force is transmitted to the fixing portion. It can however also be provided that the adjusting wheel is rotatably mounted to the fixing portion and a force is transmitted to the coupling portion by a rotation of the adjusting wheel. The spacing in the axial direction respectively relates to the axis of rotation of the adjusting wheel. The axial spacing provides that the force for moving the fixing portion relative to the coupling portion is more uniformly available, thereby making tilting more difficult.

In principle, however, the invention can also be envisaged with a single device for converting the rotary movement of the adjusting wheel into a linear movement of the fixing portion relative to the coupling portion. The device can be adapted to convert the rotary movement of the adjusting wheel into a linear movement of the abutment or holding element.

In a preferred embodiment, the transmission device is in the form of at least one spiral disk arranged on a side of the adjusting wheel. In that case, the spiral disk can be in the form of worm-shaped projections on the side of the adjusting wheel, which are in engagement with the device for converting the rotary movement into a linear movement. In those cases, the devices can be in the form of toothed bars or a similar form of a tooth arrangement or other abutment or holding surfaces arranged on the fixing portion or on the coupling portion.

In that respect, the geometry of the worm-shaped projections is selected so that it is now possible to provide for conformity of the movement of the actuating region with the movement of the fixing portion relative to the coupling portion. For that purpose the worm geometry can be of an either positively of negatively curved configuration. The appropriately correct direction of movement is set by a suitable selection of the curvature of the worm-shaped projections.

In a further embodiment of the invention the transmission device has a gear permitting appropriate conversion of directions of movement. In general, it is possible to use different conventional transmission portions which permit conversion of directions of movement.

In an advantageous embodiment of the invention the adjusting device is self-locking so that, after active adjustment of the drawer relative to the extension rail in the lateral direction or in the longitudinal direction self-acting further displacement is prevented. That self-locking action can be based for example on frictional engagement of the components of the adjusting device. For example, the worm geometry of the spiral disk can also be such that, in the case of the spiral disk being in engagement with a device for converting the rotary movement, the adjusting device is self-locking.

Additionally or alternatively there can be provided an arresting device by which the relative position of the fixing portion and the coupling portion relative to each other can be releasably arrested and which also serves to no longer permit accidental inadvertent displacement of the set positions of the fixing portion and the coupling portion relative to each other. The arresting device can for example include an eccentric screw producing a clamping action or also other means.

In an embodiment of the invention the adjusting wheel has two sides which are respectively in engagement with one of the devices for converting a rotary movement of the adjusting wheel into a linear movement of the fixing portion relative to the coupling portion. For that purpose there can be provided on the adjusting wheel, suitable means such as for example abutment surfaces, in particular the above-mentioned spiral disks, disposed on each of the sides of the wheel. By virtue of rotation of the adjusting wheel, the means can be in engagement with suitable counterpart means on the fixing portion or the coupling portion and can provide for force transmission. The worm geometry of the spiral disks on both sides of the adjusting wheel can be respectively such that the correct mode of operation of the adjusting device is guaranteed, independently of the direction of installation, that is to say, which spiral disk is in engagement with which device.

In an embodiment of the invention the adjusting wheel is mounted rotatably to the fixing portion. The coupling portion is moved linearly by the adjusting device, relative to the fixing portion, and for that purpose has two devices for converting the rotary movement of the adjusting wheel into a linear movement, in which case each of the devices is arranged on a respective lug of the coupling portion.

In comparison, another embodiment provides that the adjusting wheel is mounted rotatably to the coupling portion and the fixing portion has two lugs, on which is arranged a respective device for converting the rotary movement of the adjusting wheel into a linear movement.

The adjusting wheel can include two parts which are respectively in engagement with one of the devices for converting the rotary movement of the adjusting wheel into a linear movement when the adjusting wheel is in the mounted condition, wherein the two parts can be non-rotatably connected together. In that respect, arranged on both parts can be a respective actuating region for the adjusting wheel, which are distinguished for example by increased roughness or an external tooth arrangement, the adjusting wheel being rotated by rotation of one of the actuating regions. By virtue of the non-rotatable connection, it is sufficient if only one of the parts of the adjusting wheel is rotated. The rotary movement is automatically transmitted to the second part, wherein both parts convert the rotary movement into a linear movement by the engagement with the devices.

The device can further have a housing portion in which an opening is arranged, wherein at least one actuating region of an adjusting wheel projects out of the opening for rotation thereof, whereby the actuating region is particularly easily accessible. The opening can be arranged on the side of the device, that is to face away from the drawer bottom.

An embodiment provides that the abutment or holding element is of an elastic and/or resilient nature. It can also be provided that the abutment or holding element is spring-loaded. That is advantageous in particular when the abutment or holding element serves to support the drawer in the closed position against the abutment or holding element. The spring loading can also be adapted to return the abutment or holding element when moved by the adjusting device.

If the transmission device has a gear with which the abutment or holding element is in engagement, wherein the gear is mounted rotatably about an axis arranged substantially parallel to the longitudinal direction of the extension guide, then it is easily possible for the direction of rotation of the adjusting wheel about an axis arranged in the lateral direction to be converted to a rotation about an axis arranged in the longitudinal direction.

Depending on the respective configuration of the side or end face of the gear, an abutment or holding element in engagement therewith can be linearly displaced. If the end face is of a spiral configuration, an abutment or holding element which is in engagement with the gear can be displaced by the spiral-shaped end face, when the gear rotates. In that respect the spiral configuration of the end face can be such that the axial extent there varies along the periphery of a circle on the end face. Depending on the respective direction of rotation in which the axial extent increases, it is possible to establish the direction of the linear movement of the abutment or holding element when the gear rotates in a direction of rotation.

It is however also conceivable for the gear to be mounted rotatably about an axis arranged substantially parallel to the lateral direction, thereby providing for conversion of a rotary movement of the adjusting wheel about a longitudinal axis in a similar manner to that described above.

In an embodiment of the invention the transmission device has a bevel gear with which rotary movements can be easily converted.

The invention further concerns a device set for releasably coupling a drawer to two extendable rails of a respective extension guide, which rails are arranged at opposite sides of a furniture carcass. The device set includes a first device for releasably coupling the drawer to the first rail, the first device being of the configuration as set forth above. A second device for releasably coupling the drawer to the second rail serves to also couple the drawer to the corresponding extendable rails of an extension guide on the second side. The second device is also of a configuration as described above. The extension guides to be arranged on both sides of the drawer can each include a carcass rail and a drawer rail. A central rail can be arranged between the carcass and drawer rails. The two devices are correspondingly mounted on both sides of the drawer, in which respect it is preferably provided that the devices are to be arranged in the front region, that is to say in the region of the front panel.

The invention further concerns a device set, in which respect it is provided that only the first device has an adjusting device for relative positional displacement of the fixing portion and the coupling portion. So that the drawer is nonetheless displaceable relative to the rail in the lateral direction or in the longitudinal direction the second device is also partially movable for releasably coupling in an appropriate fashion. The second device has a second fixing portion which can be fixed to the drawer and a second coupling portion which can be coupled to the rail, wherein the second fixing portion and the second coupling portion are mounted linearly movably relative to each other for adaptation to the relative positional displacement of the fixing portion and the coupling portion of the first device.

The second coupling portion and the second fixing portion can be mounted floatingly relative to each other in a first embodiment. When the relative position of the fixing portion and the coupling portion of the first device is adjusted by the adjusting device that leads to a joint movement of the second fixing portion or the second coupling portion so that the relative position thereof is also moved.

In that case the second device can be of a structure substantially like the first device, except for the adjusting device which is not present in contrast to the first device.

The first device can also have an adjusting device as described hereinbefore for adjusting the position of the drawer in the lateral direction and in the longitudinal direction, while the second device has an adjusting device only for positional adjustment of the drawer connected to the second rail, in the longitudinal direction, and is adapted to movably follow a lateral adjustment of the first device.

In particular, an embodiment provides that the adjusting device of the second device is self-locking and additionally or alternatively has an arresting device, by which the relative position of the fixing portion and the coupling portion relative to each other can be releasably arrested.

The invention further concerns a drawer having a device as described hereinbefore or a device set as described hereinbefore, fixed to the drawer. The invention further concerns an article of furniture having at least one such drawer.

BRIEF DESCRIPTION OF THE DRAWINGS

Further details and advantages of this invention will be described more fully hereinafter by means of the specific description with reference to the drawings in which.

DETAILED DESCRIPTION OF THE INVENTION

Figure 1:
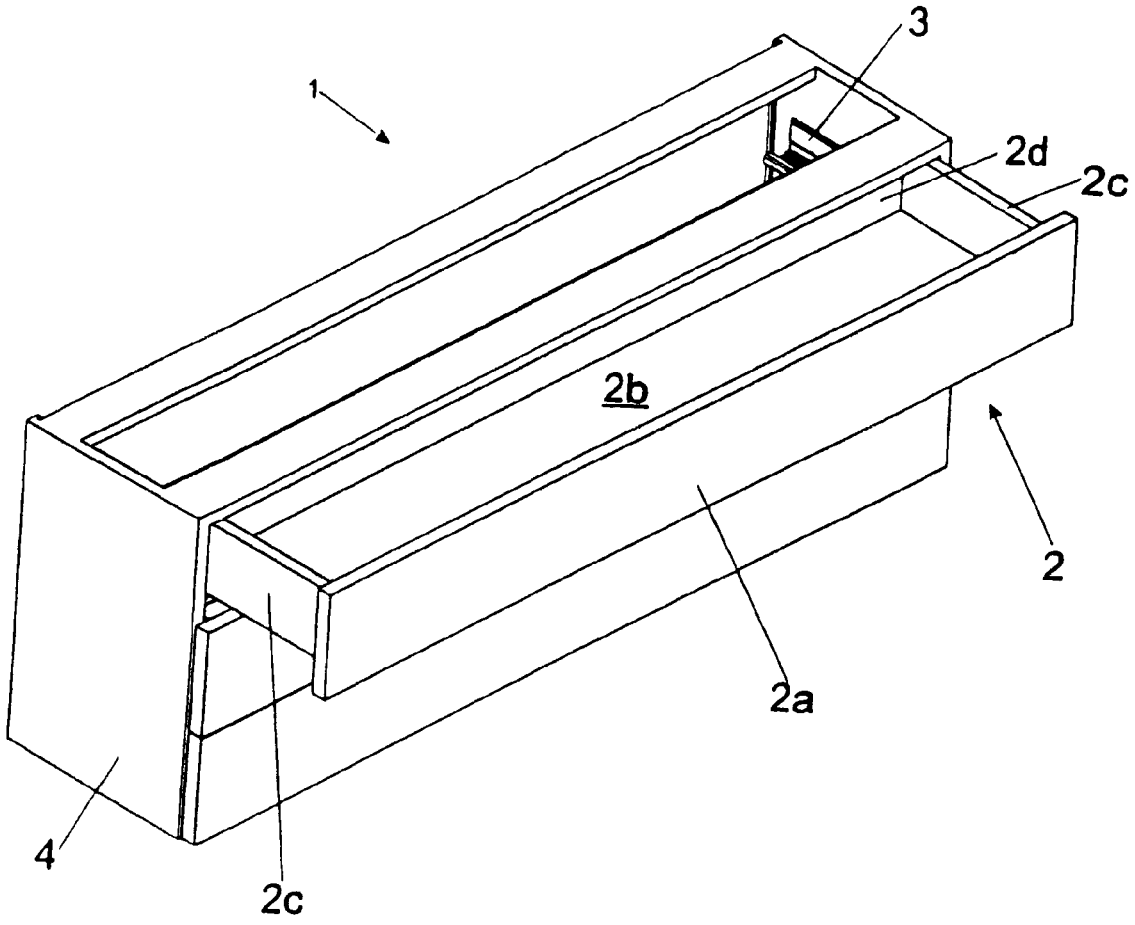
FIG. 1 shows a partly broken-away perspective view of an article of furniture according to the invention.

The partially broken-away perspective view in FIG. 1 shows an article of furniture 1 with a plurality of extendable drawers 2 which are arranged in a furniture carcass 4 and which are mounted therein by way of two respective extension guides 3 arranged at opposite sides of the furniture carcass 4. The extension guides 3 are arranged on mutually opposite side walls 2*c* of the drawer 2. At its front side, the drawer 2 has a front panel 2*a* while at its rear it has a drawer rear wall 2*d*. The drawer bottom 2*b* is arranged therebetween.

Figure 2A:
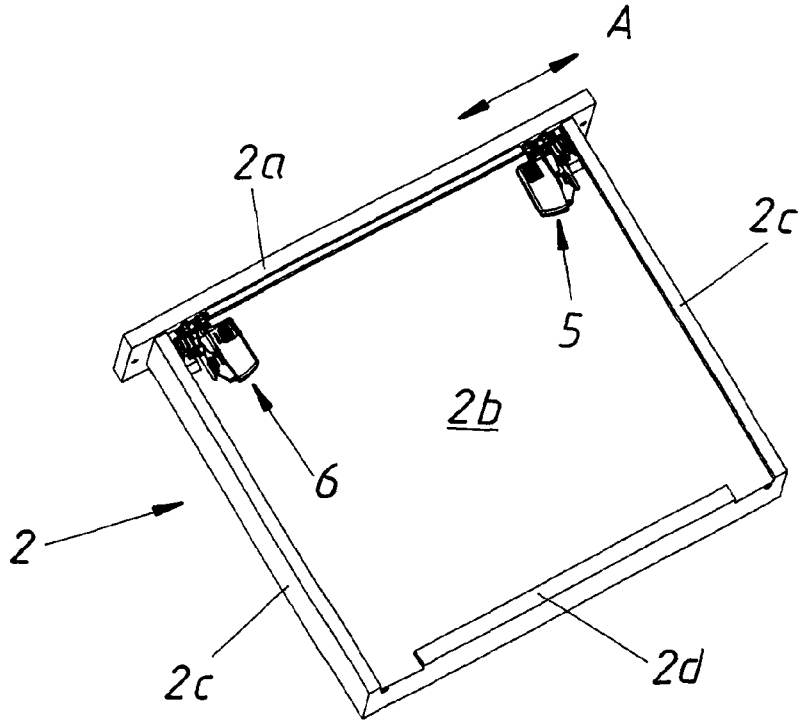
FIGS. 2*a* and 2*b* show a perspective view of the drawer bottom with a device set and a view from below on to a device according to the invention on a drawer in a first operative position.

FIG. 2*a* shows a drawer 2 from below, which at the opposite side walls 2*c* is coupled to a respective extension guide 3 by way of a first device 5 and a second device 6. For reasons of clarity of the drawing the extension guides which are known per se in the state of the art are not shown in the Figure. The extension guides 3 each include a carcass rail 3*c*, 35*c* fixed to the furniture carcass 4 which is also not shown in this Figure. In that way, the drawer 2 is coupled with a device set according to the invention to the two extension guides 3 fixed to opposite sides of the furniture carcass 4. Arranged at the front end of the drawer bottom 2*d*, which is in the region of the front panel 2*a* are the two coupling devices 5, 6 for releasably coupling to the rail 3*a* of an extension guide 3. The two devices 5, 6 each have a respective adjusting device which, by way of an adjusting wheel 8, permits lateral displacement in the direction of the double-headed arrow A (lateral direction) of the drawer 2 relative to the extension guide 3. The coupling devices 5, 6 can have such a configuration that adjustment on one side of the drawer 2 is transmitted to the adjusting device on the other side.

Figure 2B:
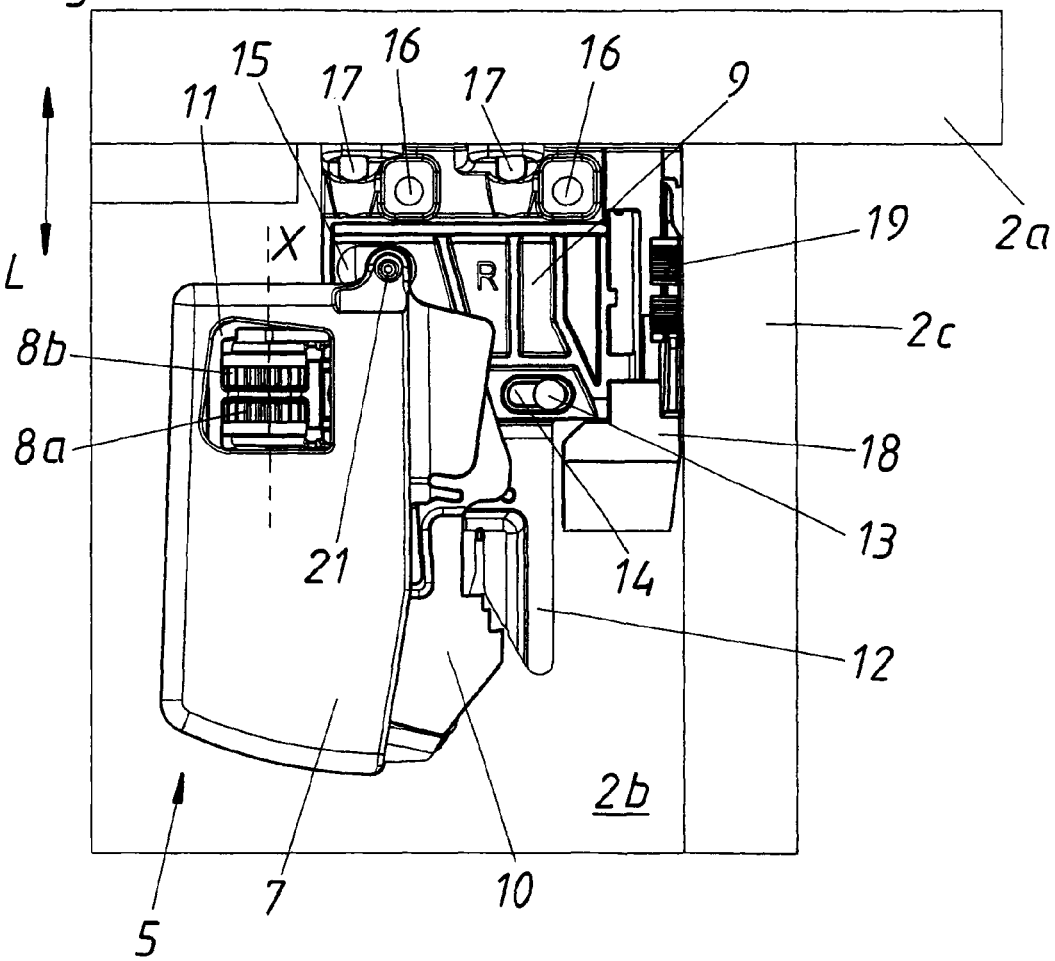

FIG. 2*b* shows a detail view of the first coupling device 5 together with a portion of the drawer 2. The mode of operation for releasably coupling the drawer 2 to an extension guide 3 is implemented in a similar manner to that in Austrian application No A 144/2010. A resilient or spring-loaded latching portion 10 is automatically latchable to a rail 3*a* of an extension guide 3 in the course of the mounting process. To release the arresting action, there is a release portion 7 in the form of a pivotal lever which is to be operated manually so that the coupling between the coupling device 5 and the extendable rail 3*a* of the extension guide 3 is releasable. The extension guide 3 is once again not shown for the sake of clarity in this Figure.

The release portion 7 has a housing opening 11, wherein the region, projecting out of the opening 11 at the respective moment in time, of the adjusting wheel 8 which is composed of two half portions 8*a*, 8*b*, represents the circumferential actuating region 37 (see FIGS. 10*a* and 10*b*) serving for rotation of the adjusting wheel 8. For that purpose, the outside surfaces of the half portions 8*a*, 8*b* have a tooth arrangement so that manual rotation of the adjusting wheel 8 is easily possible. Both half portions 8*a*, 8*b* of the adjusting wheel are mounted to the fixing portion 9 rotatably about an axis X arranged parallel to the drawer bottom 2*b* in the longitudinal direction L of the side walls 2*c*. The fixing portion 9 has fixing holes 16 for fixing the fixing portion 9 to the drawer bottom 2*b* and fixing holes 17 for fixing the fixing portion 9 to the front panel 2*a*. The coupling portion 12 includes inter alia the latching portion 10 and the release portion 7. The axis X shown in broken line, about which the adjusting wheel 8 is mounted rotatably in the mounting position, is oriented substantially parallel to the longitudinal direction L, shown by the double-headed arrow L, of the extendable rail 3*a* or the drawer 2 (i.e., parallel to extension direction of drawer 2). The regions of the two halves 8*a*, 8*b* of the adjusting wheel, that respectively project out of the opening 11, serve as the actuating region 37 for rotating the adjusting wheel 8.

Each of the two half portions 8*a*, 8*b* engage with a respective toothed bars 27*a*, 27*b* for converting a rotary movement of the adjusting wheel 8 into a linear movement of the coupling portion 12 relative to the fixing portion 9. In other words, a rotation of the adjusting wheel 8 is converted to a linear movement of the coupling portion 12 relative to the fixing portion 9. In this case, the fixing portion 9 or the coupling portion 12 can be actively moved, depending on which of those portions the adjusting wheel 8 is mounted on.

To guide the movement, the coupling portion 12 has a guide pin 13 guided in a slot 14 in the fixing portion 9. The mounting member 21 of the release portion 7 is arranged in a further slot 15 of the fixing portion 9 and also serves to guide the linear movement. In the illustrated Figure, the fixing portion 9 is in a first operative position, relative to the coupling portion 12.

As the fixing portion 9 is secured to the drawer and the coupling portion 12 is connected in the mounted condition to the extension rail 3*a*, a relative movement between fixing portion 9 and coupling portion 12 produces a relative movement between extension rail 3*a* and drawer 2. An adjusting element 18 having a handle 19 is mounted in the fixing portion 9 displaceably in the longitudinal direction of the side wall 2*c* and serves for height adjustment of the drawer 2 relative to the extension guide 3*a* as is known per se in the state of the art.

The second device 6 arranged at the side of the drawer 2 opposite to the first coupling device 5 can in this respect have substantially the same structure as the first device 5.

Figure 3:
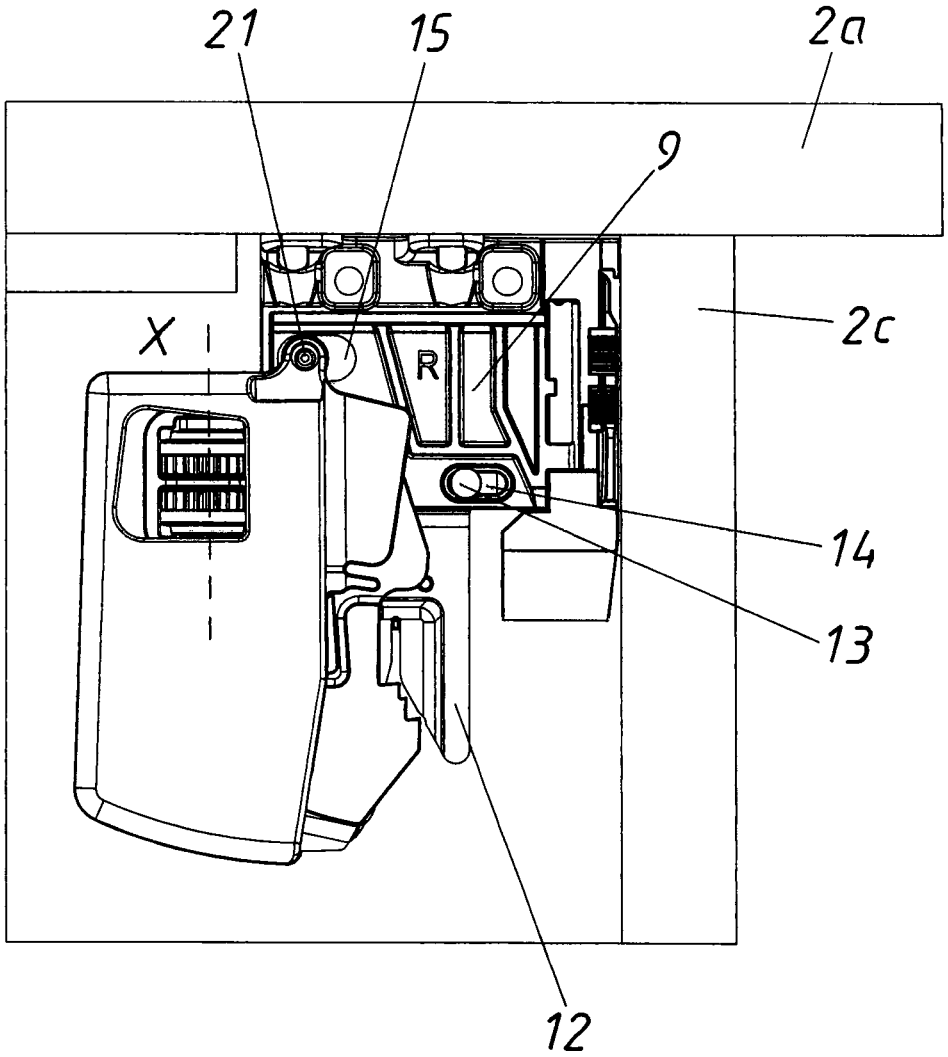
FIG. 3 shows a view from below on to a device according to the invention on a drawer in a second operative position.

FIG. 3 shows the arrangement of FIG. 2*b* with the difference being that a rotation of the adjusting wheel 8 provides that the coupling portion 12 has moved with respect to the fixing portion 9 in a direction facing away from the illustrated side wall 2*c*. The device has been moved into a second operative position, although this does not involve any limitation to the two illustrated operative positions. The relative displacement of the fixing portion 9 with respect to the coupling portion 12 can be seen by means of the guide pin 13 which, in contrast to FIG. 2*a*, is disposed in FIG. 3 in the region of the left-hand end of the slot 14. The same applies to the mounting member 21 in the slot 15. The extension rail 3*a* (not shown in this Figure) is connected in the mounted condition to the coupling portion 12 so that, with the coupling portion 12, the rail 3*a* was also laterally displaced relative to the fixing portion 9 and thus relative to the drawer 2.

Figure 4A:
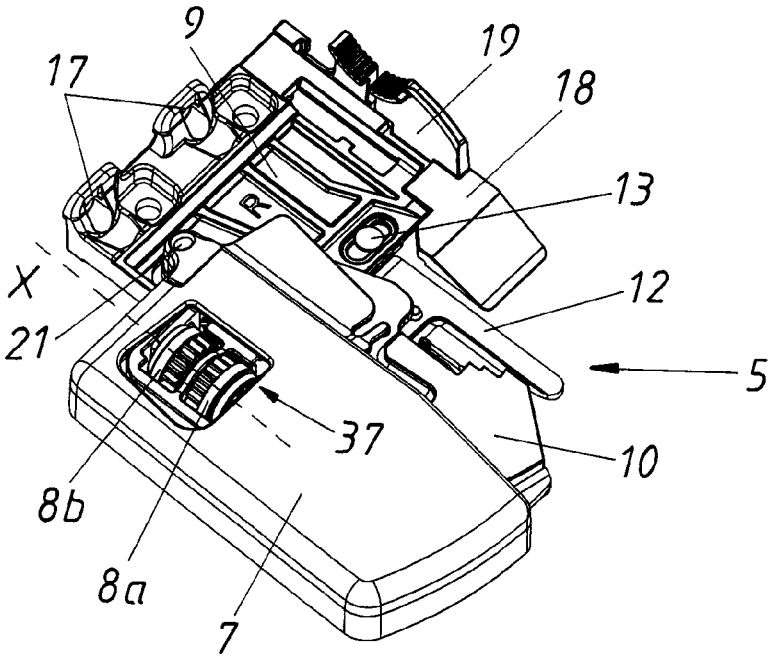
FIGS. 4*a* through 4*d* show a perspective view and a partly broken-away perspective view of a device according to the invention together with a detail view and a further perspective view of the device.

FIG. 4*a* shows a perspective view of the coupling device 5. The coupling device 5 corresponds with all its components to the embodiment shown in FIG. 2*b*. It can be seen that part of the half portions 8*a*, 8*b* of the adjusting wheel 8 project out of the opening 11, that is to say they project beyond the surface of the release portion 7. Those projecting regions form the actuating region 37.

Figure 4B:
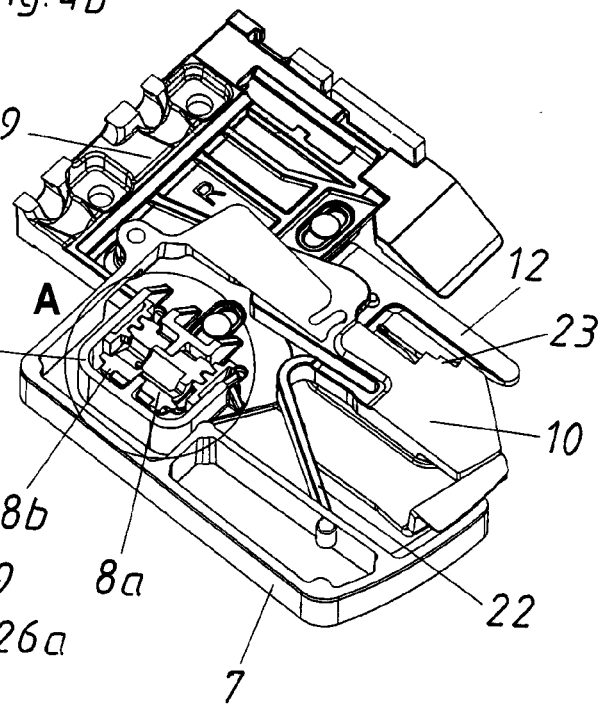

FIG. 4*b* shows the device 5 of FIG. 4*a* in a partly broken-away view. It can be seen that the latching portion 10 has stepped abutment surfaces 23 which, in a per se known manner, can be caused to bear against an edge of an opening in the extension rail 3*a*, wherein the abutment surfaces 23 are arranged in mutually displaced relationship in the extension direction of the drawer 2, thereby permitting sequential latching engagement of the latching portion 10 on the extension rail 3*a*. The latching portion 10 is mounted resiliently by a flexible strut 22. The coupled condition of the latching portion 10 is released by the release portion 7.

Figure 4C:
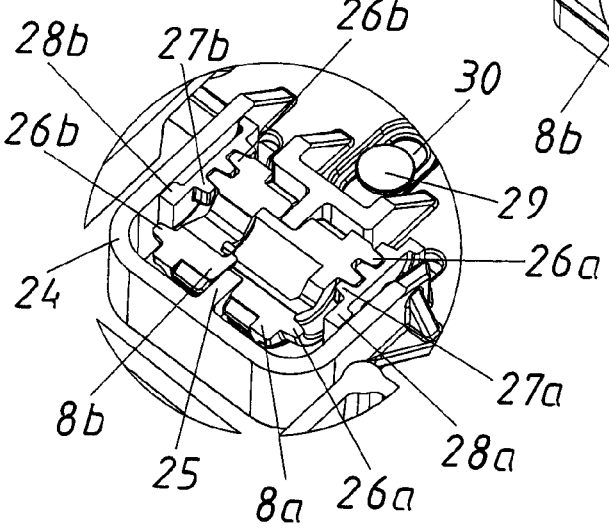

The detail view shown in FIG. 4*c* of the portion of FIG. 4*b* marked by A shows a broken-away view of the adjusting device. The fixing portion 9 has a casing 24 in which the adjusting device is arranged. The adjusting wheel 8 has the half portions 8*a*, 8*b* which are non-rotatably connected together and which are mounted to a limb 25 of the casing 24 rotatably about an axis. In the mounted condition of the device 5, that axis is arranged substantially in a longitudinal direction of the side wall 2*c* of the drawer 2 and the extension guide 3, respectively.

Arranged at the sides of each of the half portions 8*a*, 8*b* of the adjusting wheel 8 is a spiral disk 26*a* and 26*b*, and the side faces of the disks 26*a*, 26*b* have respective worm-shaped (spiral) projections. The spiral disks 26*a*, 26*b*, that is to say the worm-shaped projections, engage into the toothed bars 27*a* and 27*b* respectively. The toothed bars 27*a*, 27*b* are respectively arranged on a respective lug 28*a* and 28*b* in turn arranged on the coupling portion 12. The lugs 28*a*, 28*b* and the coupling portion 12 can be in one piece. Rotation of one of the half portions 8*a*, 8*b* of the adjusting wheel 8 is automatically transmitted to the respective other half by virtue of the non-rotatable connection. The spiral disks 26*a* and 26*b* engage with the toothed bars 27*a* and 27*b* so that the worm-shaped projections of the spiral disks 26*a*, 26*b* are guided along the teeth of the toothed bars 27*a*, 27*b* by virtue of rotation of the adjusting wheel 8, thereby providing relative positional displacement of the lugs 28*a*, 28*b* with respect to the casing 24. As the casing 24 is fixedly connected to the fixing portion 9 and the lugs 28*a*, 28*b* are fixedly connected to the coupling portion 12, that results in conversion of the rotary movement of the adjusting wheel 8 into a linear movement of the fixing portion 9 relative to the coupling portion 12. The lugs 28*a*, 28*b*, with the toothed bars 27*a*, 27*b*, thus serve as transmission devices 20*a*, 20*b* according to the invention for converting the rotary movement. It is also possible to see a slot 30 which is arranged in the fixing portion 9 and in which a guide pin 29 of the coupling portion is displaceably guided and which also serves for guiding the movement. As the fixing portion 9 is fixedly connected to the drawer, the drawer 2 is moved relative to the furniture carcass 4 to which the extension guide 3 is fixed by a linear movement of the fixing portion 9 relative to the coupling portion 12. According to the invention, in that respect the direction of the relative movement of the drawer 2 relative to the furniture carcass 4 corresponds to the direction of a tangential component of the rotation of the actuating region 37 of the adjusting wheel 8.

Figure 4D:
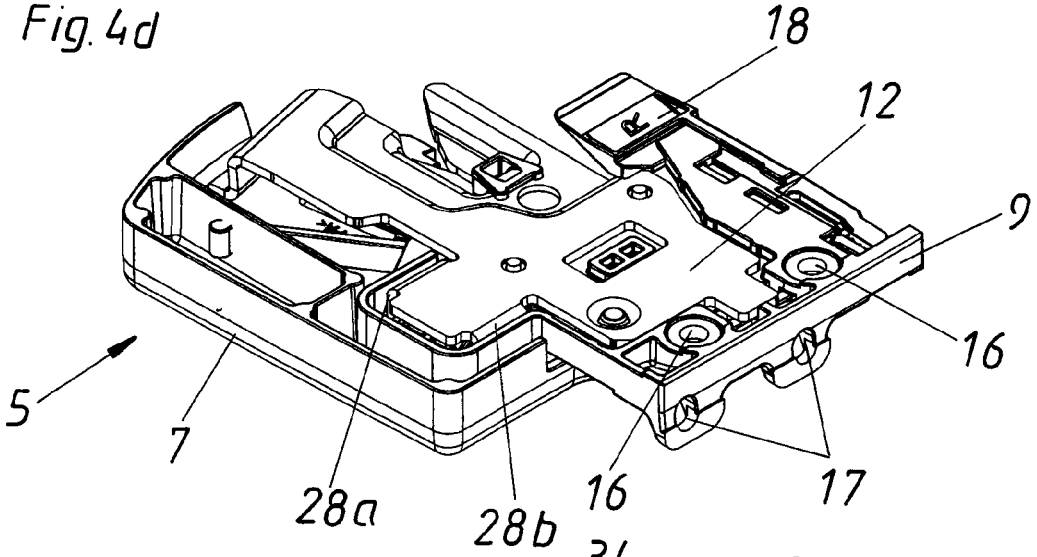

FIG. 4*d* shows a perspective view from below of the coupling device 5. It will be seen that the lugs 28*a*, 28*b* are in the form of bent-over abutment surfaces on the coupling portion 12 and in this case are therefore made in one piece with the coupling portion 12.

Figure 5:
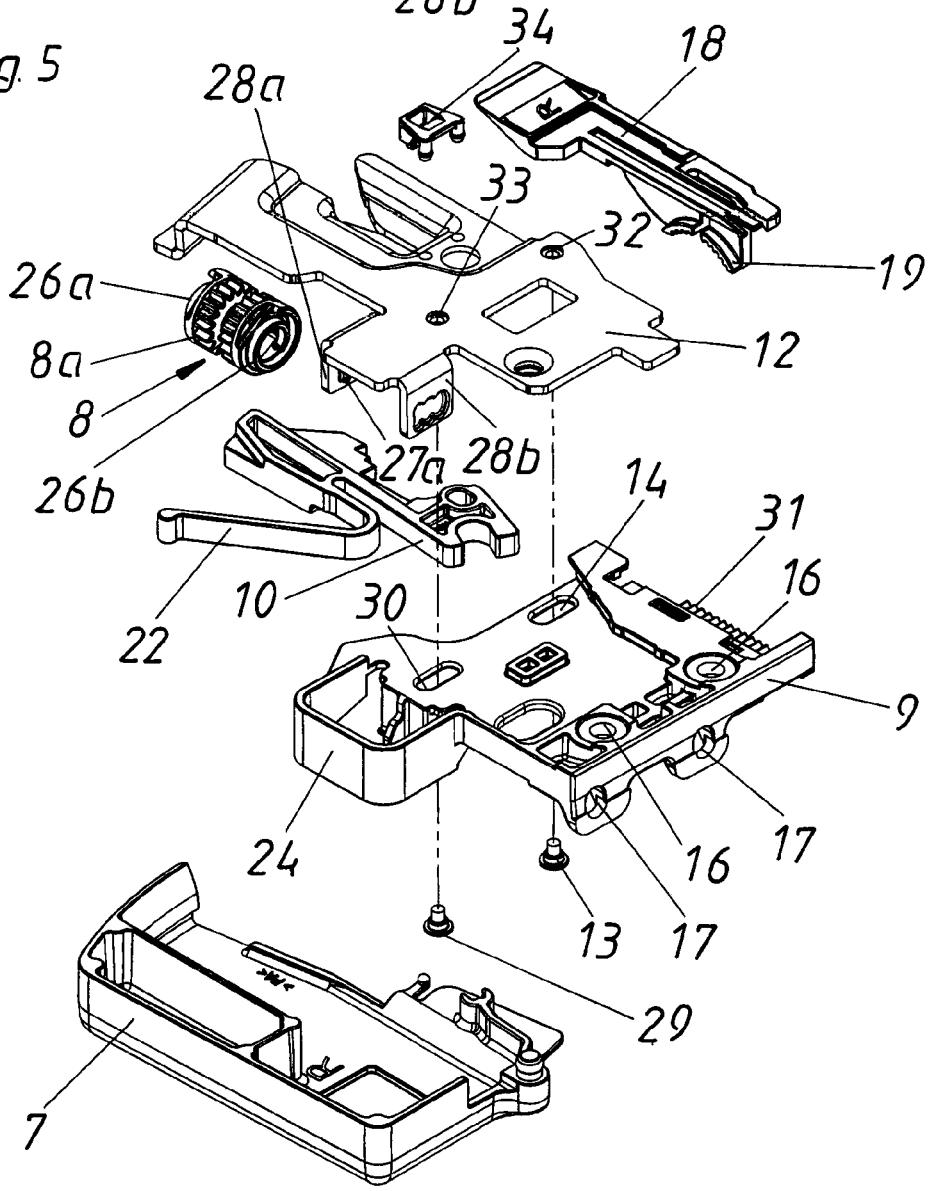
FIG. 5 shows an exploded view of a device according to the invention.

FIG. 5 shows an exploded view of the components of the coupling device 5. It is possible to see the lugs 28*a* and 28*b* which are arranged on the coupling portion 12 and at the inside of which is arranged a respective toothed bar 27*a*, 27*b* which can be brought into engagement with worm-shaped projections in the form of a respective spiral disk 26*a*, 26*b* on the two half portions 8*a*, 8*b* of the adjusting wheel 8, that are non-rotatably connected together. The fixing portion 9 mounted to the drawer 2 by way of fixing holes 16 and 17 respectively has a further tooth arrangement 31 which can be brought into engagement with the adjusting element 18 for height adjustment. It is also possible in addition to see the casing 24 formed on the fixing portion 9. As can be seen by the broken lines, the guide pins 13 and 29 which are fitted in bores 32 and 33 in the coupling portion 12 serve to connect the fixing portion 9 to the coupling portion 12. As the guide pins 13 and 29 are fitted into the slots 14 and 30 respectively in the fixing portion 9, this connection gives limited linear mobility of the fixing portion 9 relative to the coupling portion 12. The elastically yielding material portion 34 serves to compensate for a difference in length when the extension rail 3*a* is in engagement with the coupling portion 12.

Figure 6A:
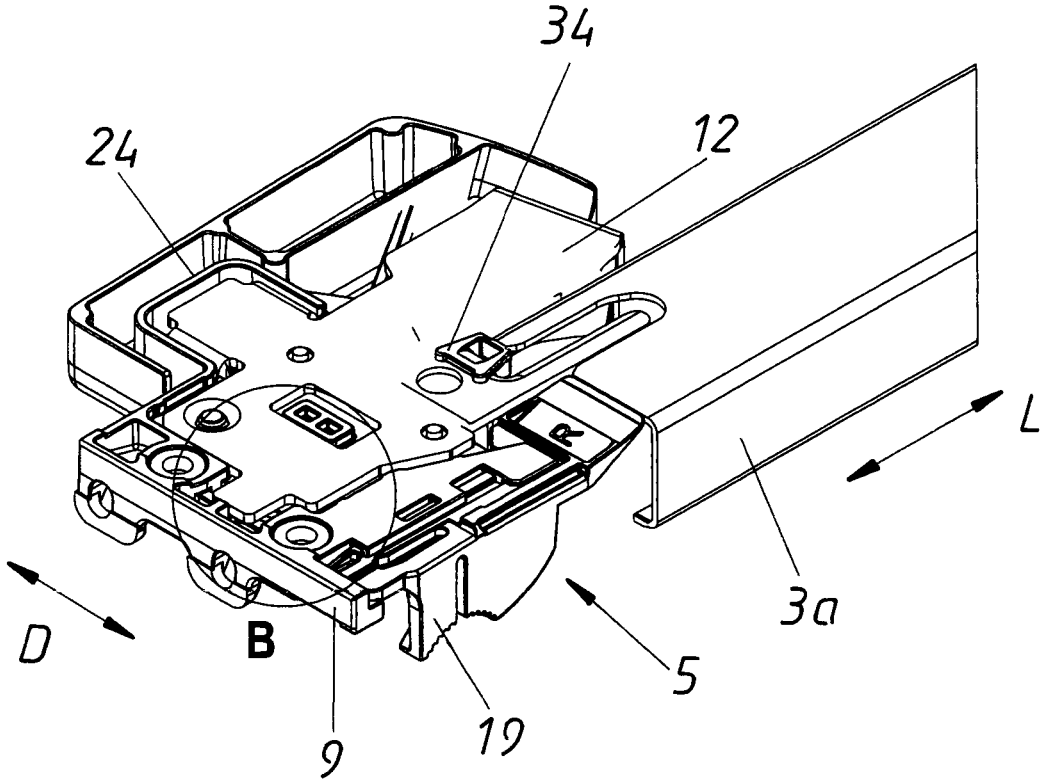
FIGS. 6*a* and 6*b* show a perspective view of a device according to the invention arranged on an extension guide in a first operative position and a detail view thereof.

FIG. 6*a* shows a perspective view of the coupling device 5 connected to an extension rail 3*a*. The coupling portion 12 and therewith the extension rail 3*a* connected thereto can be moved by the adjusting wheel 8 relative to the fixing portion 9 and thus the drawer 2 connected thereto, in the direction of the double-headed arrow D.

Figure 6B:
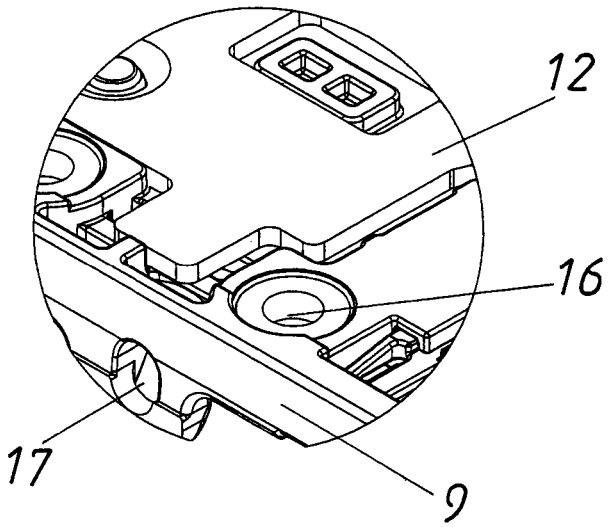

FIG. 6*b* shows a detail view of the portion marked by B in FIG. 6*a*. The coupling portion 12 and the fixing portion 9 are in a first operative position.

Figure 7A:
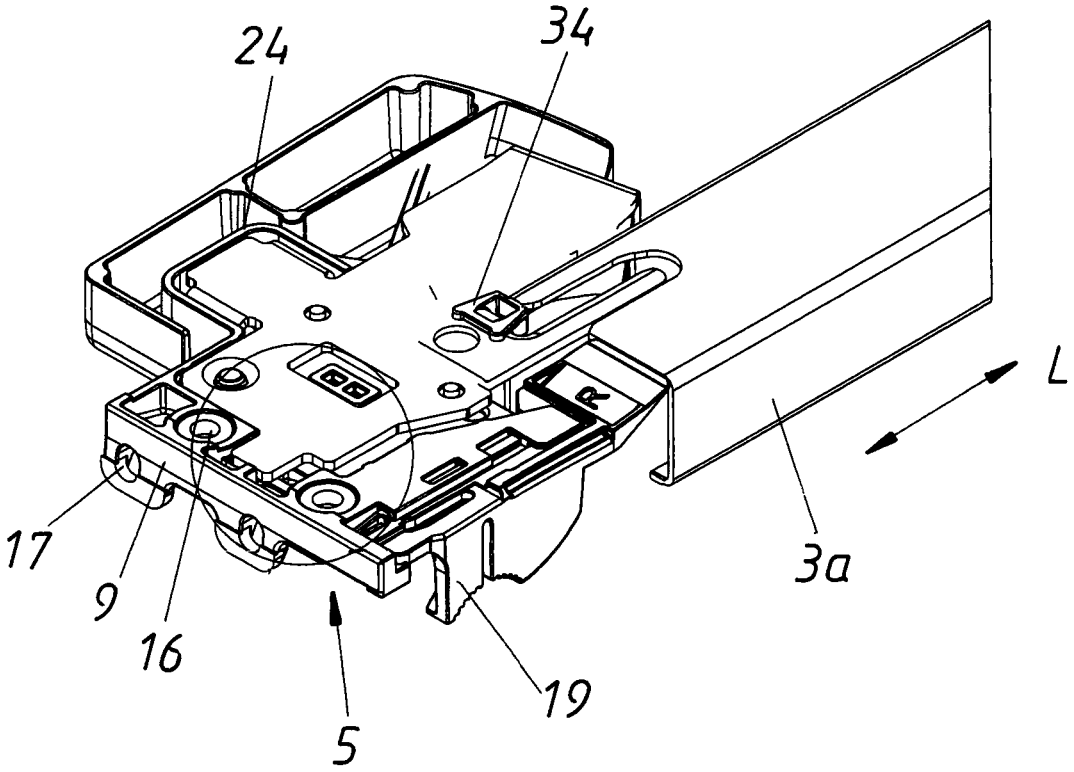
FIGS. 7*a* and 7*b* show a perspective view of a device according to the invention arranged on an extension guide in a second operative position together with a detail view thereof.
Figure 7B:
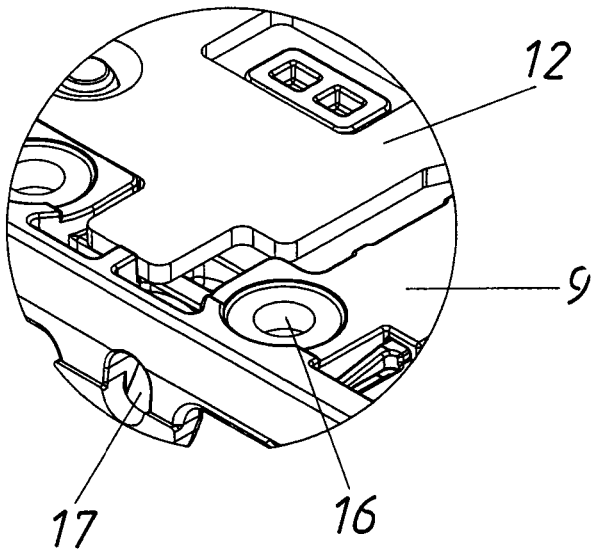

FIGS. 7*a* and 7*b* differ from FIGS. 6*a* and 6*b* in that the coupling portion 12 is in a second operative position relative to the fixing portion 9. Thus, the coupling portion 12 with connected extension rail 3*a* has been displaced linearly relative to the fixing portion 9, in relation to FIGS. 6*a* and 6*b*.

Figure 8A:
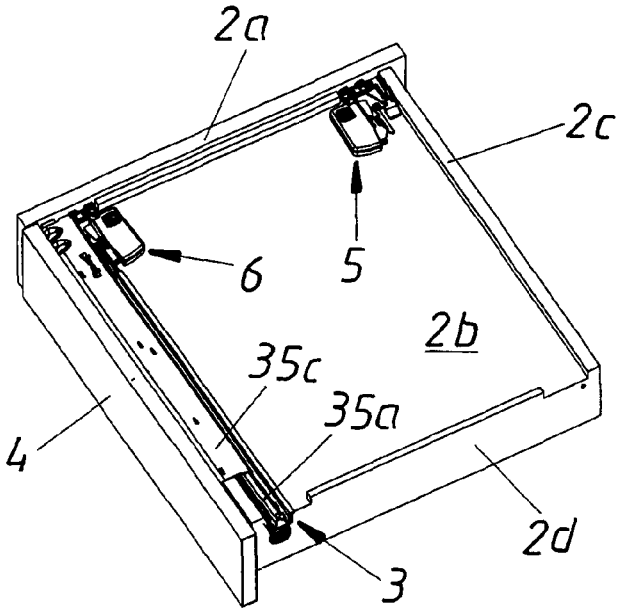
FIGS. 8*a* and 8*b* show a perspective view of a drawer bottom with a device set according to the invention and a view from below on to a device according to the invention in a first operative position.

FIG. 8*a* shows a perspective view from below of a drawer 2, showing an extension guide 3 on a side wall 2*c* of the drawer 2 while no extension guide 3 is shown on the opposite side wall 2*c* for reasons of clarity of the drawing. The second coupling device 6, which is in opposite relationship to a first coupling device 5 for releasably coupling a drawer 2 to an extendable rail 3*a* of an extension guide 3 and which also serves for releasable coupling, is shown in the condition of being coupled to the extendable rail 35*a*. In addition, shown on that side of the drawer 2, at which the extension guide 3 is illustrated, is a region of the furniture carcass 4, to which the carcass rail 35*c* of the extension guide 3 is fixed.

Figure 8B:
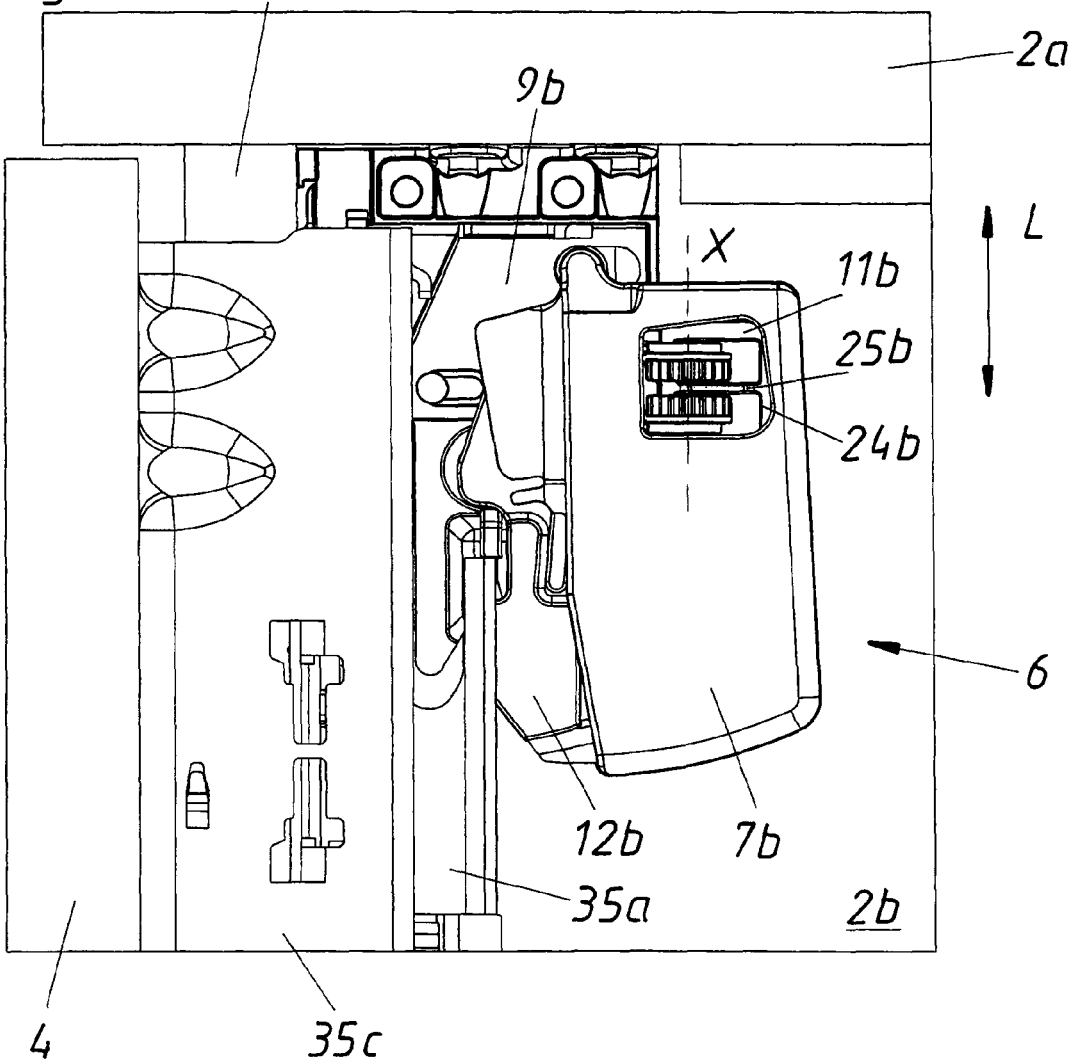

FIG. 8*b* shows a detail view of the second device 6 together with the region of the drawer 2 and the furniture carcass 4. The carcass rail 35*c* is fixed to the furniture carcass 4. The extension rail 35*a* displaceable relative to the carcass rail 35*c* is in engagement with the second coupling device 6 so that the drawer 2 is overall coupled to the extension guide 3. There can optionally be a central rail mounted movably between the carcass rail 35*c* and the extendable rail 35*a*. The second coupling device 6 comprises substantially the same components as the first coupling device 5, with the proviso that the second coupling device 6 is to be arranged on a side of the drawer 2, that is opposite to the first coupling device 5, so that for example the release portion 7*b* of the second device for releasing the drawer 2 from the extendable rail 35*a*, when viewed from below, is turned in the clockwise direction around the mounting location 21*b*, while the release portion 7 of the first device 5 is rotated in the counter-clockwise direction around the mounting location 21 to release the coupling. In other words, some of the components of the second coupling device 6 are thus in mirror-symmetrical relationship with the corresponding components of the first coupling device 5, but involve the same function. The second coupling device 6, like the first coupling device 5, has an adjusting wheel 8*b* which comprises two half portions 36*a* and 36*b* which can be fixedly connected together, and by which adjusting wheel 8*b* the second fixing portion 9*b* is linearly movable relative to the coupling portion 12*b* and thus permits lateral adjustment of the drawer 2 relative to the extension guide 3. The adjusting wheel of the second device 6 is rotatably mounted to a limb 25*b* of a casing 24*b*, wherein a second actuating region projects from a housing opening 11*b* or projects beyond the release portion 7*b*.

It is possible once again to see the longitudinal direction L of the drawer 2, which corresponds to the longitudinal direction L of the extendable rail 35*a* and the extendable rail 3*a*, and the axis X which is arranged substantially parallel to the longitudinal direction L (i.e., the extension direction of the drawer) and around which the two half portions 36*a*, 36*b* of the adjusting wheel 8*b* of the second coupling device 6 are rotatably mounted.

When adjustment is effected in the lateral direction at the first coupling device 5, that movement is transmitted to the second coupling device 6 so that the second fixing portion 9*b* moves relative to the second coupling portion 12*b* whereby the drawer 2 is adjusted relative to the furniture carcass 4. It is also possible to see that the join appearance of the drawer 2 arranged in the furniture carcass 4 is not optimum as the front panel 2*a* involves a large lateral spacing relative to the outside wall of the furniture carcass 4.

Figure 9A:
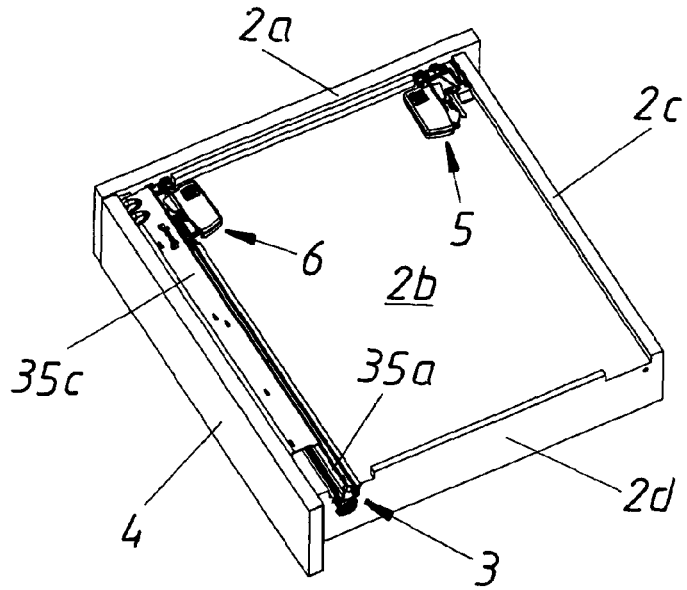
FIGS. 9*a* and 9*b* show a perspective view of a drawer bottom with a device set according to the invention and a view from below on to a device according to the invention in a second operative position.
Figure 9B:
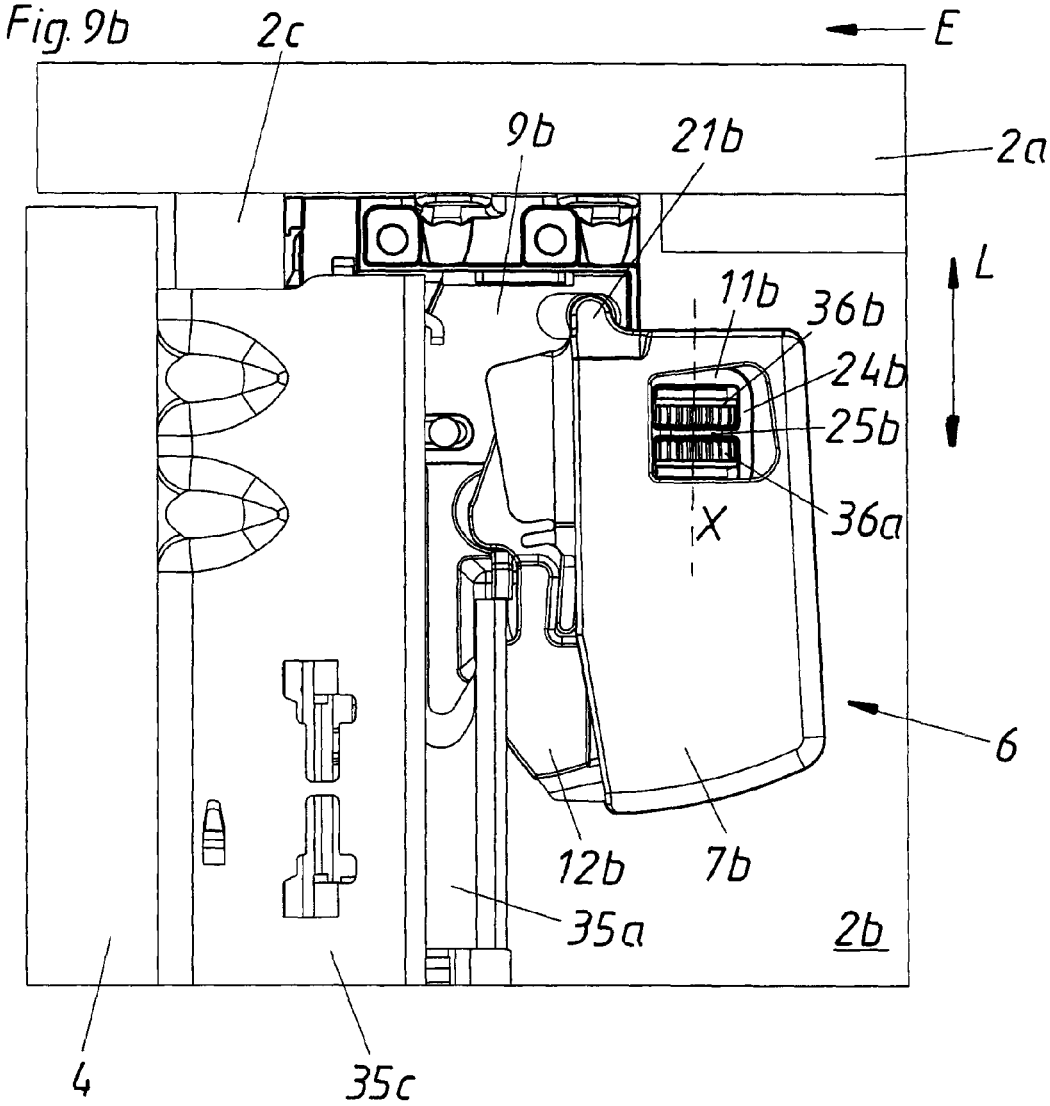

FIGS. 9*a* and 9*b* show the same arrangement as FIGS. 8*a* and 8*b*. However, the drawer 2 together with the front panel 2*a* has been moved in the direction of the arrow E relative to the extension guide 3 and thus relative to the furniture carcass 4 by a rotation of the actuating region of the adjusting wheel 8 or of the adjusting wheel of the second device 6. The join appearance is markedly tidier as the lateral spacing of the front panel 2*a* relative to the outside wall of the furniture carcass 4 is markedly less.

Figure 10A:
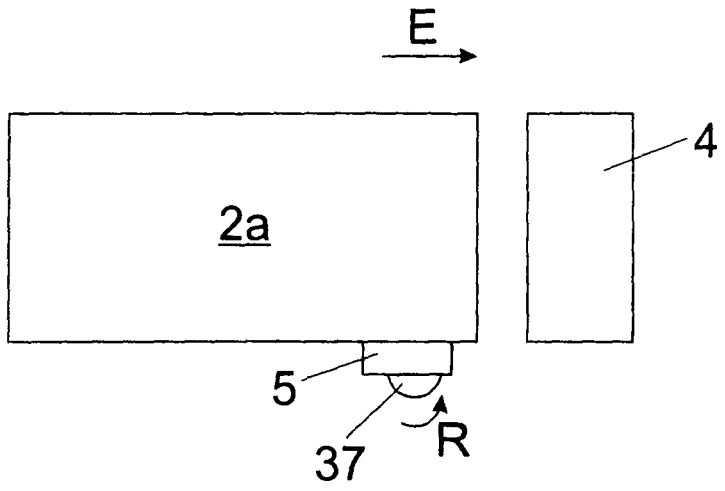
FIGS. 10*a* through 10*d* show diagrammatic views illustrating the operating principle of a device according to the invention.

To diagrammatically illustrate the operating principle of the invention, FIG. 10*a* shows a diagrammatic view of a drawer 2 from the front, which is arranged in a furniture carcass 4 and is provided with a coupling device 5. Only a side wall of the furniture carcass 4 is shown. The size relationships of this view do not correspond to the real dimensions, but are only selected for illustration reasons. The actuating region 37 of the adjusting wheel 8, that projects downwardly from the housing, serves to rotate the wheel.

Using the coupling device 5, the drawer 2 and therewith also the front panel 2*a* connected to the drawer 2 can be displaced in the lateral direction relative to the extendable rail 3*a*. As the extendable rail 3*a* is mounted movably in a carcass rail 3*c* which, in turn, is arranged on the side wall of the furniture carcass 4, the device 5 ultimately produces lateral displacement of the drawer 2 with front panel 2*a* with respect to the furniture carcass 4. The device 5 thus makes it possible to provide a tidy join appearance. The components of the extension guide 3 are not shown for the sake of clarity of the drawing.

Lateral displacement of the front panel 2*a* in the direction E towards the side wall of the furniture carcass 4 is effected by rotation of the adjusting wheel 8 in a first direction R. In that case, the movement of the actuating region 37 occurs at the lowermost region of the adjusting wheel 8. In that case, the tangential component of the first direction of rotation R is the same as the direction E. In other words, the movement of the actuating region 37 coincides with the direction E of the movement or the adjustment of the front panel 2*a* relative to the furniture carcass 4. As the front panel 2*a* is fixedly connected to the fixing portion 9 and the furniture carcass 4 is coupled to the coupling portion 12 by the carcass rail 3*c* and the extendable rail 3*a*, the movement of the actuating region 37 is also in conformity with the movement of the fixing portion 9 relative to the coupling portion 12.

Figure 10B:
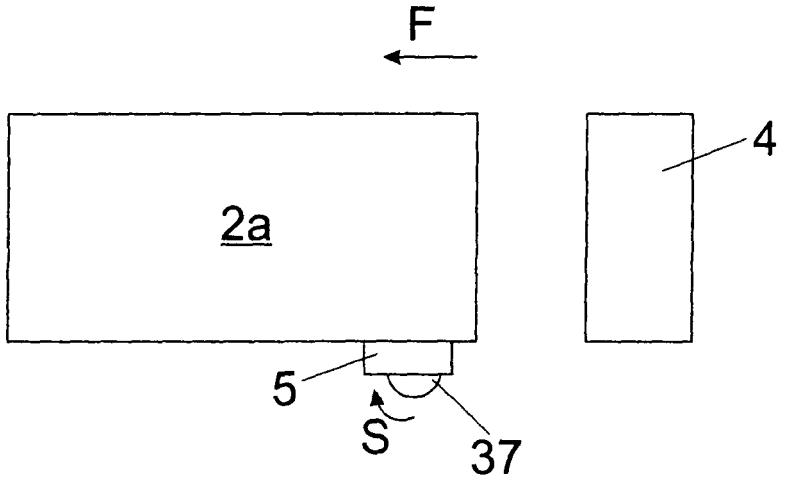

In FIG. 10*b*, the adjusting wheel 8 is rotated in a second direction S, for which purpose once again the actuating region 37 is moved at the lowermost end of the adjusting wheel 8, this time in the opposite direction to the direction described with reference to FIG. 10*a*. Once again, the movement of the actuating region 37 is in conformity with the direction F of the lateral displacement of the front panel 2*a* and therewith the drawer 2 relative to the furniture carcass 4, the drawer in this case being moved away from the side wall of the furniture carcass 4. As the front panel 2*a* and therewith the drawer 2 are fixedly connected to the fixing portion 9 and the furniture carcass 4 is coupled to the coupling portion 12 by the carcass rail 3*c* and the extendable rail 3*a* in this case also the movement of the actuating region 37 is in conformity with the movement of the fixing portion 9 relative to the coupling portion 12.

Figure 10C:
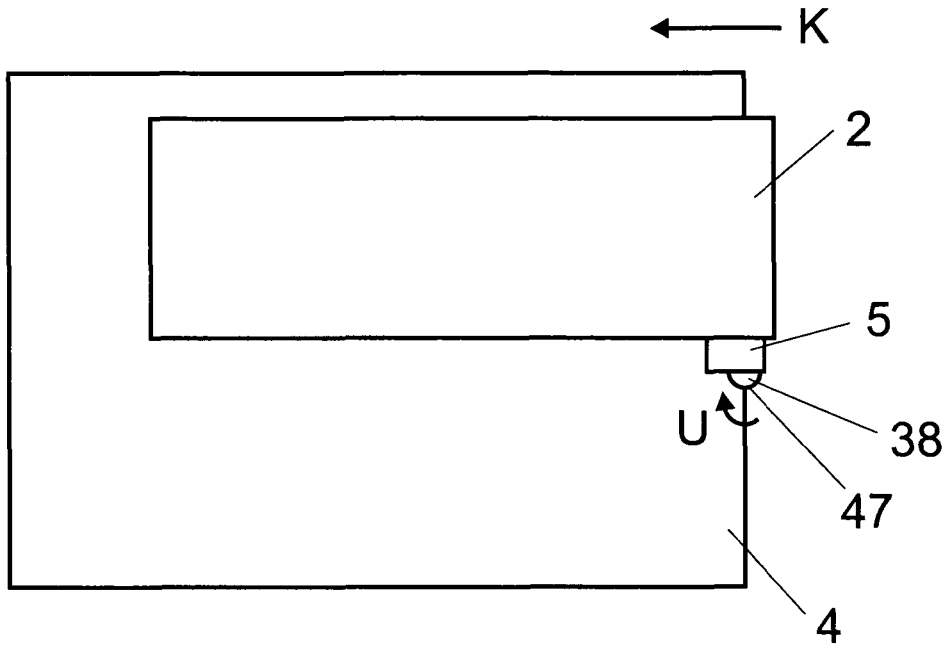

FIG. 10*c* is a diagrammatic view showing the function in terms of depth adjustment, that is to say adjustment of the position of the drawer 2 relative to the furniture carcass 4 in the longitudinal direction L. In that respect, such adjustment acts only on the closed position of the drawer 2 when it is in the closed end position in the furniture carcass 4. Adjustment of the closed position of the drawer 2 and thus the front panel 2*a* relative to the furniture carcass 4 is possible by the coupling device 5. It is possible in that way to homogenize a join appearance which is untidy in that direction. Once again, the components of the extension guide 3 are not shown for the sake of clarity of the drawing.

Adjustment of the closed position of the front panel 2*a* in the direction K towards the rear wall of the furniture carcass 4 is effected by rotation of the second adjusting wheel 38 in a first direction of rotation U. In that case the movement of the actuating region 47 take place at the lowermost region of the second adjusting wheel 38. In that respect, the tangential component of the first direction U bearing against the wheel 38 is the same as the direction K. In other words, the movement of the actuating region 38 is coincident with the direction K in which the closed position of the front panel 2*a* and thus the drawer 2 relative to the furniture carcass 4 is adjusted.

Figure 10D:
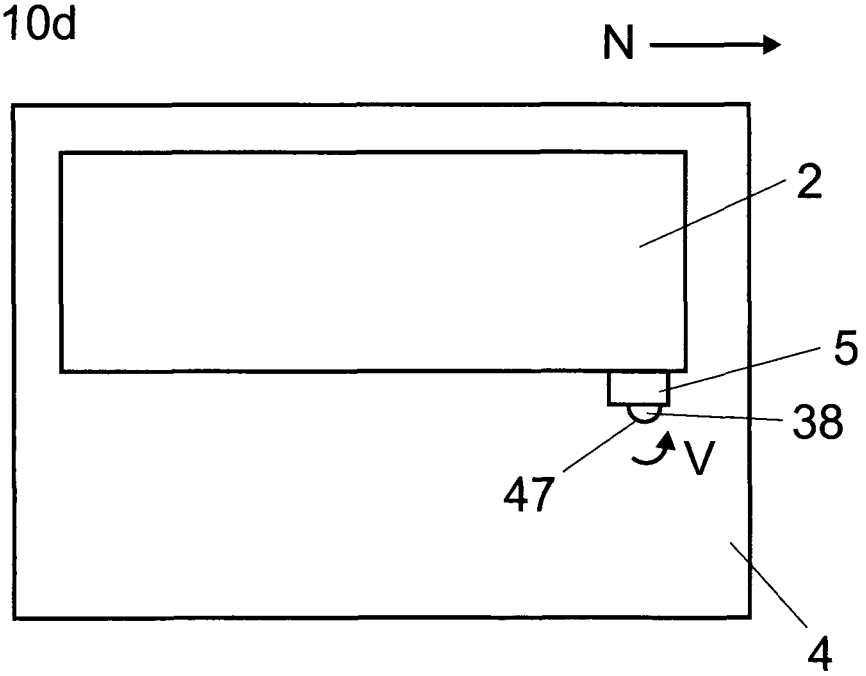

In FIG. 10*d* the second adjusting wheel 38 is rotated in a second direction V, wherein the movement of the actuating region 47 is again implemented at the lowermost end of the adjusting wheel 38, this time in the opposite direction to that described with reference to FIG. 10*c*. Once again, the movement of the actuating region 47 is identical to the direction N in which the closed position of the front panel 2*a* and thus the drawer 2 is adjusted relative to the furniture carcass 4, in which case adjustment is in the direction of the open end of the furniture carcass 4, that is to say in the direction of opening the drawer 2.

It will be seen from FIGS. 10*a* through 10*d* that according to the invention, an intuitively particularly simple adjustment option by virtue of the coupling device 5 can be achieved. To permit those conformities in terms of the directions of movement for the lateral adjustment, the transmission device used in an embodiment of the invention, based on spiral disks 26*a*, 26*b* on the sides of the adjusting wheel 8, involves a curvature of suitable sign. If in comparison the sign of the curvature is altered, that is to say a spiral disk 26*a*, 26*b* with worm-shaped projections which are "wound" differently is adopted, the direction of movement of the fixing portion 9 relative to the coupling portion 12 turns round, with the same direction of rotation of the adjusting wheel 8.

What is common to the adjusting options in FIGS. 10*a* through 10*d* is that the direction in which the actuating region 37, 47 of the adjusting wheels 8, 38 is moved is in conformity with the direction in which the position of the drawer 2—at least in the closed end position—is adjusted relative to the furniture carcass 4.

Figure 11A:
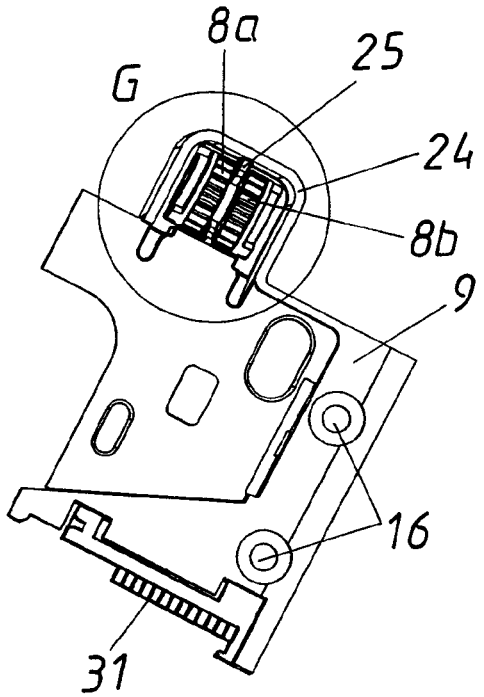
FIGS. 11*a* through *c* show perspective views of the fixing portion of the device and a detail view thereof.

FIG. 11*a* shows a perspective view of the fixing portion 9 to which an adjusting wheel 8 consisting of two half portions 8*a*, 8*b* is mounted rotatably to a limb 25 within a housing 24. The large part of the fixing portion 9 is in the form of a mounting plate. It is possible to see bored holes 16 with which the fixing portion 9 can be fixed to the drawer bottom 2*d*.

Figure 11B:
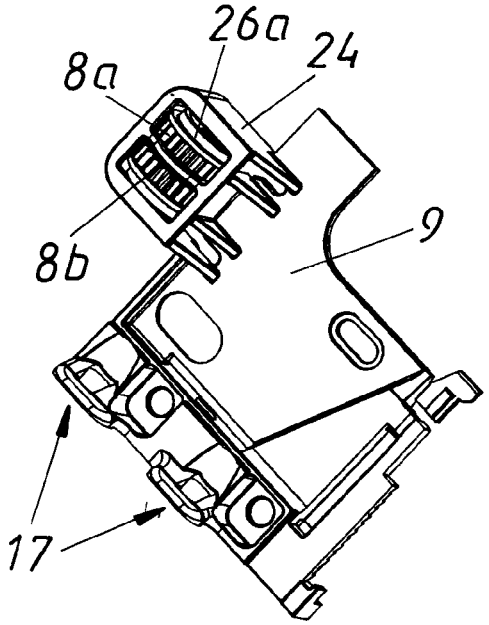

FIG. 11*b* shows a perspective view of the fixing portion 9 with rotatably mounted adjusting wheel 8 from a different viewing angle. It is possible here to see the holes 17 with which the fixing portion 9 can be fixed to the front panel 2*a*.

Figure 11C:
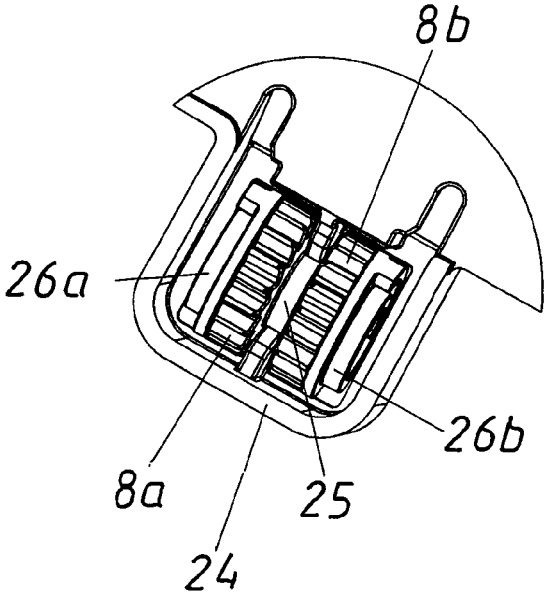

FIG. 11*c* shows a detail view of the portion marked by G in FIG. 11*a*. It is possible to see the spiral disks 26*a*, 26*b* arranged at the sides of the adjusting wheel 8, in the form of worm-shaped projections. The two half portions 8*a*, 8*b* of the adjusting wheel respectively have an external tooth arrangement so that the adjusting wheel 8 can be more easily actuated. It will be seen from FIG. 11*b* that a part of the adjusting wheel 8 projects out of the housing 24. That projecting or protruding region serves as the actuating region of the adjusting wheel. The two half portions 8*a*, 8*b* are non-rotatably connected together and mounted rotatably to a limb 25.

Figure 12A:
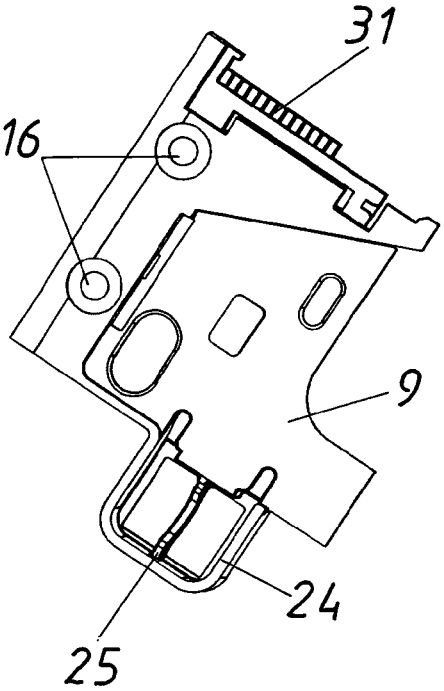
FIGS. 12*a* through *c* show perspective views of the fixing portion and the adjusting wheel in the separated condition, and an exploded view of the adjusting wheel.

FIG. 12*a* shows a perspective view of the fixing portion 9 without the adjusting wheel 8. It is possible to see in particular the limb 25 to which the adjusting wheel 8 is rotatably mounted.

Figure 12B:
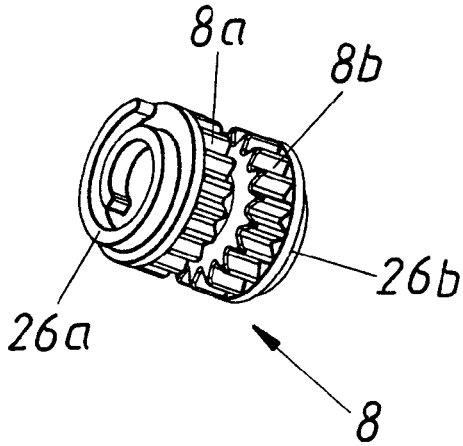
Figure 12C:
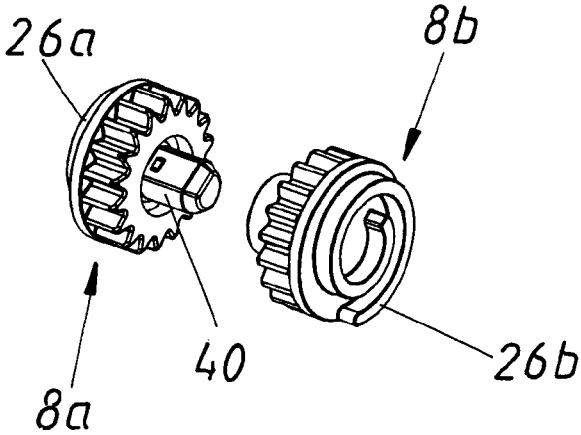

FIG. 12*b* shows a perspective view of the adjusting wheel 8 consisting of two half portions 8*a*, 8*b*. It is possible to clearly see the spiral disk 26*a* which is in the form of worm-shaped projections. The spiral disk 26*b* on the second half portion 8*b* is of a mirror image configuration.

FIG. 12*b* shows an exploded view of the adjusting wheel 8. The two half portions 8*a*, 8*b* can be non-rotatably connected together, in which respect the non-rotatable connection can be implemented using means known per se in the state of the art. For example, a latching connection or a snap-action connection is conceivable. Thus, disposed on one half portions can be is a pin 40 which by way of an opening or mounting means on the limb 25, engages non-rotatably into a counterpart means on the other half of the adjusting wheel 8.

Figure 13:
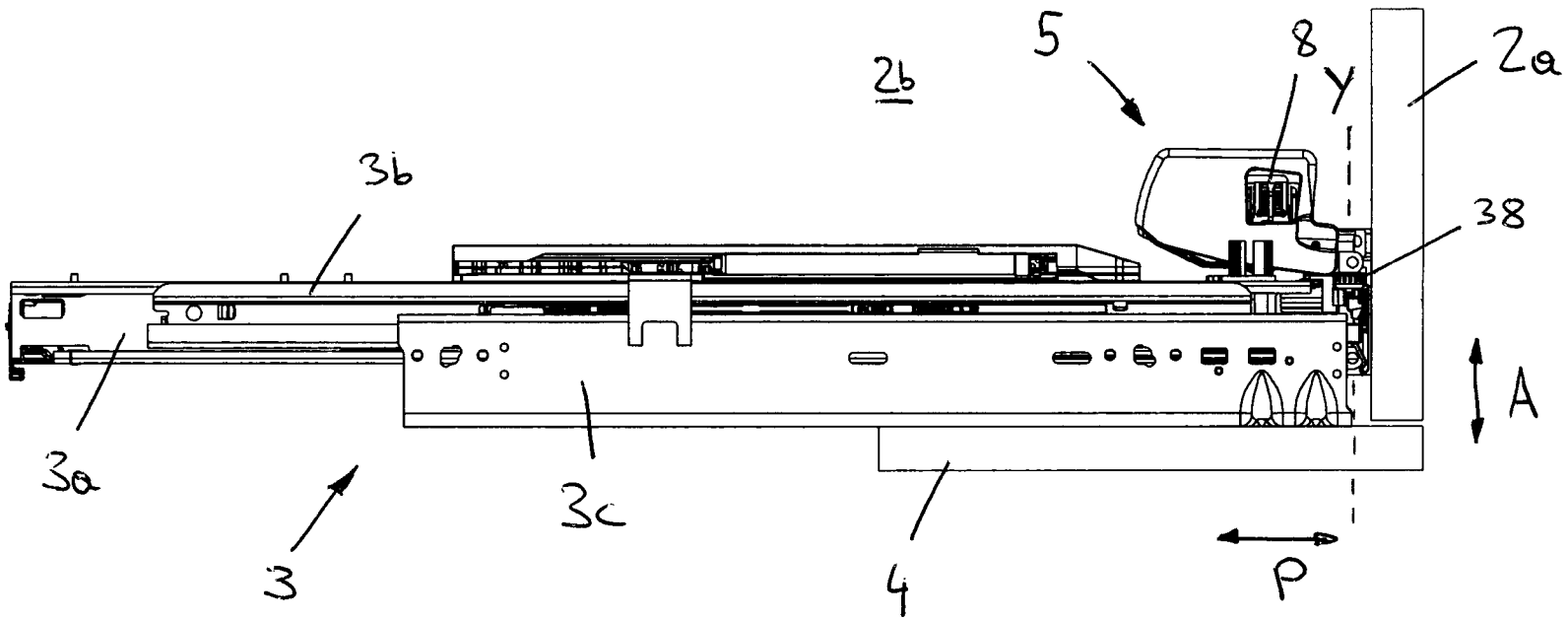
FIG. 13 shows a plan view of an extension guide with a further embodiment of a device according to the invention.

FIG. 13 shows a plan view illustrating a portion of an extension guide 3 including a carcass rail 3*c* arranged on a side wall of the furniture carcass 4, an extendable rail 3*a* and a central rail 3*b* arranged between the extendable rail 3*a* and the carcass rail 3*c*. The drawer is fixed with the front panel 2*a* and the drawer bottom 2*b* to a further embodiment of the coupling device 5 according to the invention. The device 5 has a fixing portion 9 and a coupling portion 12 for that purpose. The device is coupled to the extendable rail 3*a* by way of the coupling portion 12. The device has a first adjusting wheel 8, by means of which the position of the drawer 2 relative to the extension guide 3 and thus relative to the furniture carcass 4 in the direction of the double-headed arrow A can be effected in the above-described manner.

The coupling device 5 has an adjusting wheel 38, by which the closed position of the drawer 2 can be adjusted in the direction of the double-headed arrow P by rotation about an axis Y which in the mounted position is arranged horizontally and perpendicularly to the longitudinal direction L, in the manner set forth hereinafter.

Figure 14A:
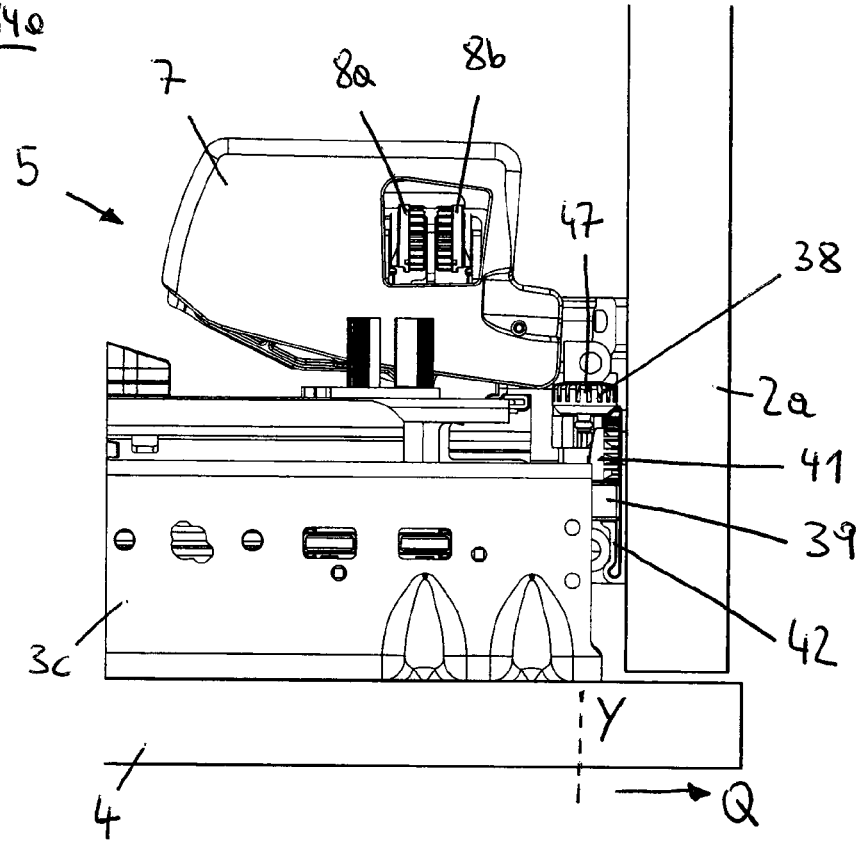
FIGS. 14*a* and 14*b* show two views from below of a device according to the invention in different operative positions.

FIG. 14*a* shows a plan view illustrating details of the coupling device 5 of FIG. 13. In this case the drawer 2 represents a so-called internal extension arrangement in which the front panel 2*a*, in the closed end position, is intended to terminate flush with the furniture carcass 4. It will be seen however that the closed position of the drawer 2, as illustrated in this Figure, has been wrongly set as the front panel 2*a* is arranged excessively deep in the furniture carcass 4 and does not terminate flush therewith. The abutment element 39 mounted linearly movably on the fixing portion 9 can be displaced relative to the fixing portion 9 and thus relative to the front panel 2*a* in the longitudinal direction O of the extension guide 3, by way of the second adjusting wheel 38.

The extension guide 3 has a spring-assisted retraction device, by which the drawer 2 can be automatically pulled into the furniture carcass 4 in an opened position. Such a retraction device is known in the state of the art. The drawer 2 is held in the closed position by that retraction device. The retraction movement of the drawer 2, implemented by the retraction device, is limited by the abutment element 39 insofar as in the closed end position of the drawer 2 the abutment element is caused to bear against the carcass rail 3*c* so that further movement in the direction of the closed position, that is to say in opposite relationship to the illustrated arrow Q is prevented.

Insofar as the actuating region 47 of the second adjusting wheel 38 is now moved in the direction of the arrow Q the abutment element 39 is moved away from the front panel 2*a*, in the opposite direction thereto. As that abutment element 39 which for that purpose can be of an elastic material or can be of a resilient nature is supported against the carcass rail 3*c* the front panel 2*a* and thus the drawer 2 are moved in the direction of the arrow Q by the relative movement of the abutment element 39 relative to the front panel 2*a* so that the adjusting direction of the closed position of the drawer 2 relative to the furniture carcass 4 is identical to the direction of movement of the actuating region 47.

Figure 14B:
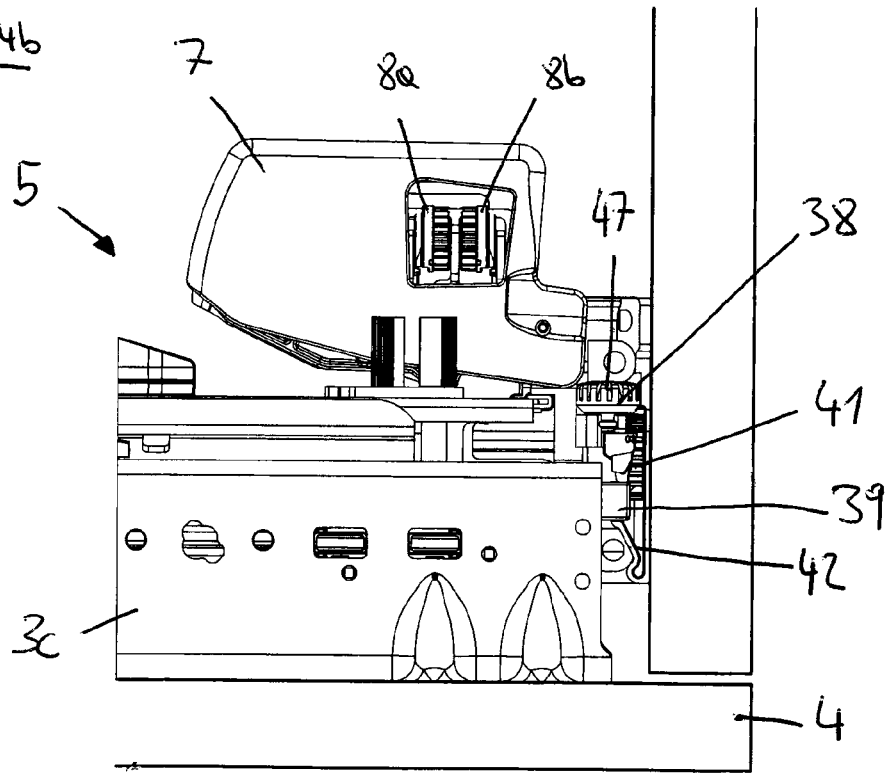

FIG. 14*b* shows a flush join appearance which is produced by the foregoing adjustment procedure and in which the front panel 2*a* terminates flush with the furniture carcass. It will be seen that the abutment element 39 has been moved away from the front panel 2*a* relative to the fixing portion 9 and thus relative to the drawer 2 connected thereto. A movement of the actuating region 47 in the reverse direction in relation to FIG. 14*a* causes the abutment element 39 to be moved in the direction of the front panel 2*a* again, whereby the front panel 2*a* moves towards the carcass rail 3*c*, by virtue of the spring-assisted retraction device, in which case the abutment element 39 bears against the carcass rail 3*c*. Therefore, by means of the second adjusting wheel 38, the closed position of the drawer 2 can be adjusted forward and back in the longitudinal direction of the extension guide.

Figure 15A:
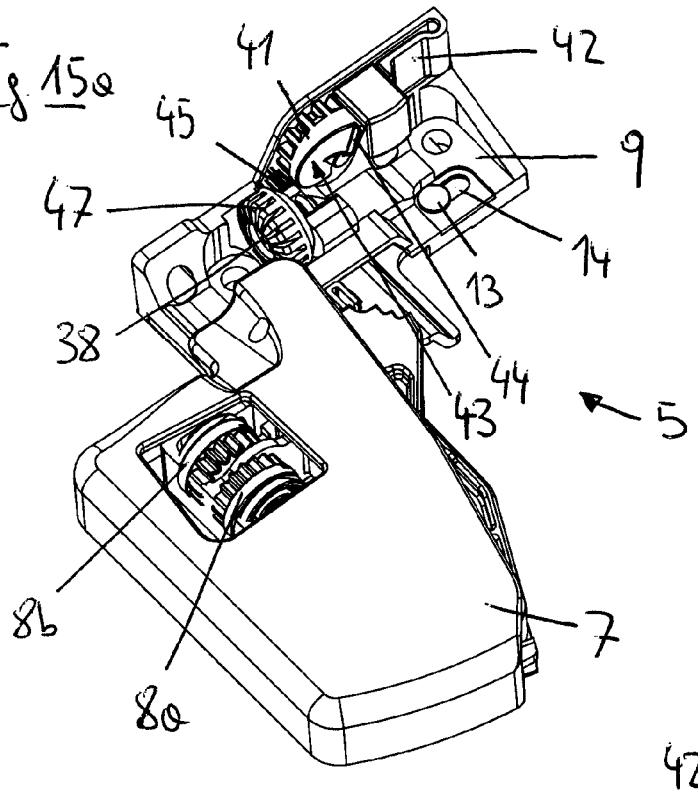
FIGS. 15*a* and 15*b* show two perspective views of the device according to the invention in different operative positions.

FIG. 15*a* shows a perspective view of the coupling device 5 in the operative position of FIG. 14*a*. The second adjusting wheel 38 is operatively connected to a gear 41 by way of a bevel gear 45 whereby rotation of the second adjusting wheel 38 about an axis Y which in the mounted position is arranged horizontally and perpendicularly to the longitudinal direction L can be converted into a rotary movement of the gear 41 about an axis arranged in the longitudinal direction. The gear 41 has a spiral-shaped end face 43, that is to say the outside dimensions of the gear 41 increase in the axial direction along the periphery. Depending on the direction of rotation in which the axial outside dimensions increase, it is possible to control the direction of rotation of the adjusting wheel 38, by which the abutment element 39 is moved away from or towards the front panel 2*a*. An abutment surface 44 limits the rotatability of the gear 41 and thus the second adjusting wheel 38. The abutment element 39 is guided by the face 43 in such a way that the abutment element is movable in the longitudinal direction L of the extension guide 3 by virtue of rotation of the gear 41, as a consequence of the increasing axial extent, relative to the fixing portion 9 and thus the coupling portion 12. As the abutment element 39 bears against the carcass rail 3*c* in the closed position of the drawer 2, the drawer 2 is thereby moved relative to the carcass rail 3*c* and thus the furniture carcass 4 and the closed position is correspondingly adjusted.

As described above, adjustment of the lateral position of the drawer 2 relative to the furniture carcass 4 is implemented by the adjusting wheel 8 and its two half portions 8*a* and 8*b*. It is possible to see a slot 14 and a guide pin 13 arranged therein, which serve to guide the lateral movement.

Figure 15B:
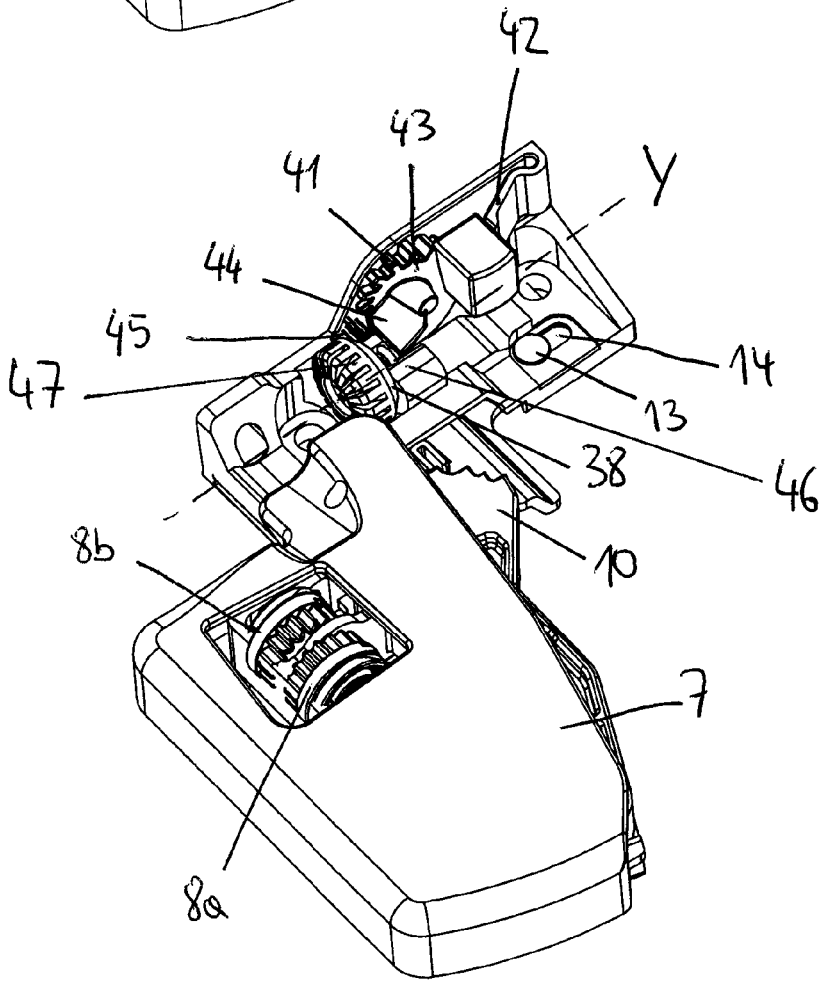

FIG. 15*b* shows a perspective view of the device 5 in the operative position shown in FIG. 14*b*, in which the abutment element 39 has been moved relative to the fixing portion 9 and thus the front panel 2*a* by having been displaced in that direction as a consequence of the increasing axial extent of the gear 41. It is possible to see the abutment surface 44 for limiting the movement of the gear 41 and the mounting means 46 of the second adjusting wheel 38. In the mounted position, the actuating region 47 of the second adjusting wheel is arranged in the region of the lowermost position of the adjusting wheel 38, just as in the case of the adjusting wheel 8. In the perspective view in FIGS. 15*a* and 15*b*, that position is the uppermost position of the adjusting wheels 8, 38.

Figure 16A:
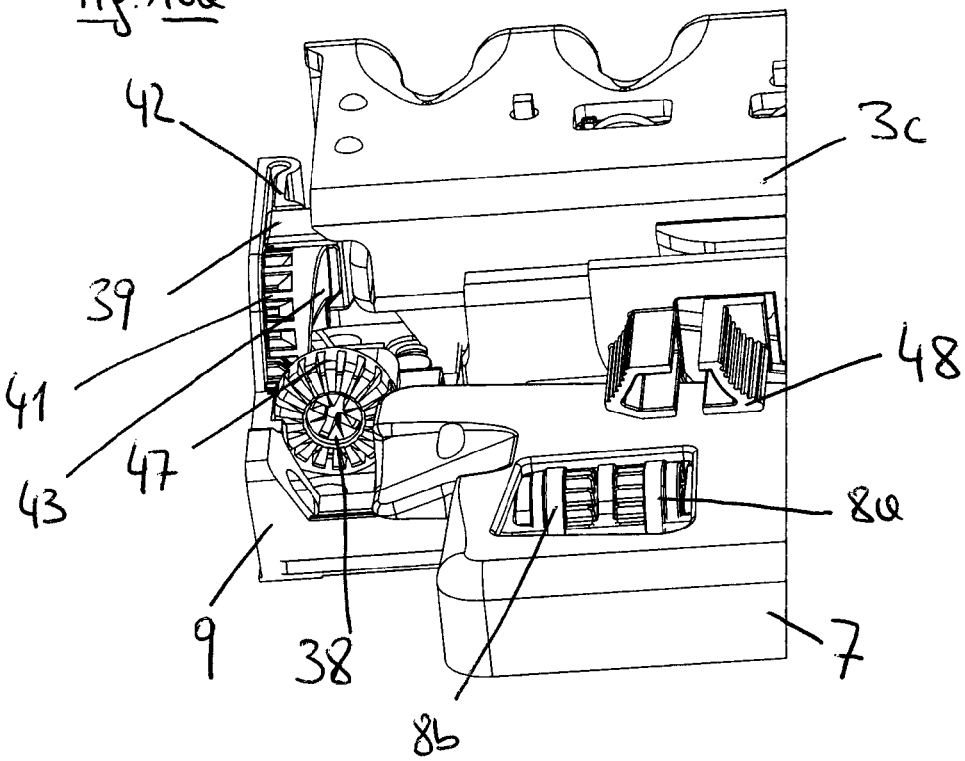
FIGS. 16*a* and 16*b* shows further perspective views of a device according to the invention in different operative positions, the device being connected to the extension guide.

FIG. 16*a* shows a further perspective view of the coupling device 5 in the operative position shown in FIG. 14*a*, the coupling device 5 being coupled to the extension guide 3. The drawer 2 is in its closed end position and thus in the closed position in which the abutment element 39 bears against the carcass rail 3*c*. It is possible to see the spiral-shaped end face 43, by which the abutment element 39 is guided during its relative movement. In this embodiment the coupling device 5 further has a device 48 for height adjustment, which is described in Austrian patent application A 511/2011.

Figure 16B:
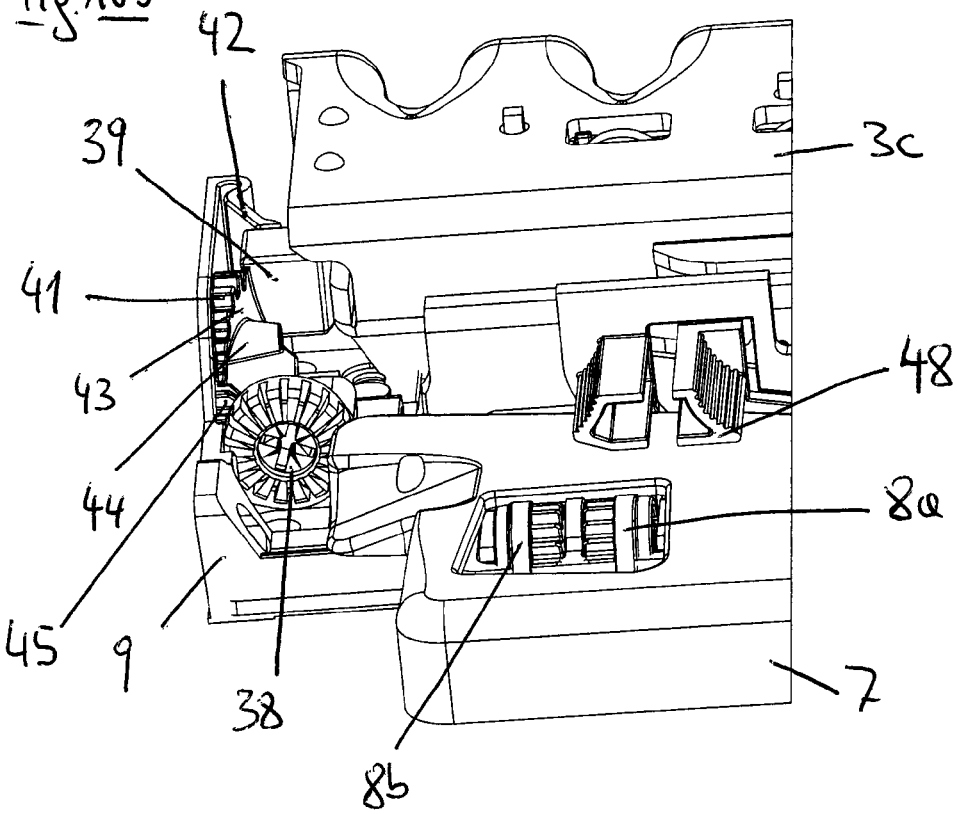

FIG. 16*b* shows a further perspective view of the coupling device 5 in the operative position of FIG. 14*b*, in which respect it can be clearly seen once again how the abutment element 39 is guided by the face 43 of the gear 41. It is also possible to see how rotation of the second adjusting wheel 38 about an axis Y arranged laterally in the mounted position is converted by means of a bevel gear 45 into a rotation of the gear 41 about an axis arranged in the longitudinal direction L, whereby once again the abutment element 39 is linearly moved in the longitudinal direction L. Ultimately that movement causes adjustment of the closed position of the drawer 2 in such a way that the direction of movement of the actuating region 47 is the same as the adjustment direction for the closed position of the drawer 2 relative to the furniture carcass 4.

Figure 17A:
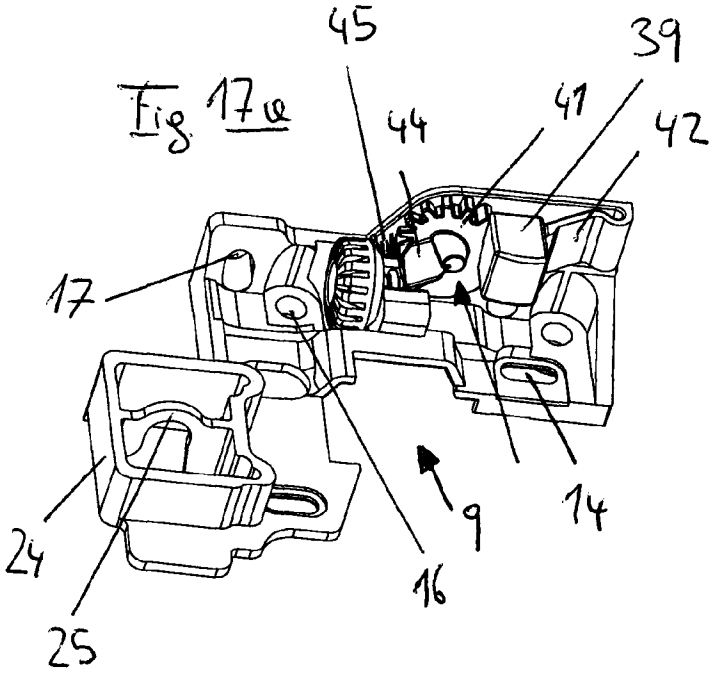
FIGS. 17*a* and 17*b* show a further perspective view of the fixing portion and an associated exploded view.

FIG. 17*a* shows a perspective view of the fixing device 9 of the coupling device 5 in the embodiment of FIGS. 13 through 16. It is possible to see the casing 24 with the limb 25 in which the two half portions 8*a* and 8*b* of the adjusting wheel 8 are mounted rotatably for lateral adjustment. Arranged beside the slot 14 are further slots for guiding the lateral displacement. Fixing holes 16 and 17 serve for fixing the fixing portion 9 to the drawer 2*b* and to the front panel 2*a*.

The abutment element 39 is arranged on a flange 49 of the spring element 42. By virtue of the rotation of the gear 41 and the end face 43 of a spiral shape the spring element 42 with flange 49 is moved relative to the fixing portion 9 from the neutral position. That also applies to the abutment element 39 arranged on the flange 49. If, upon rotation of the adjusting wheel 38 and therewith the gear 41 the axial extent of the gear 41 becomes less in the region of the abutment element 39 the flange 49 of the spring element 42 is automatically moved in the direction of the wall element 50 of the fixing portion 9, by virtue of the spring action. The abutment element 39 arranged on the flange 49 is thus automatically returned by virtue of the spring action of the spring element 42.

Figure 17B:
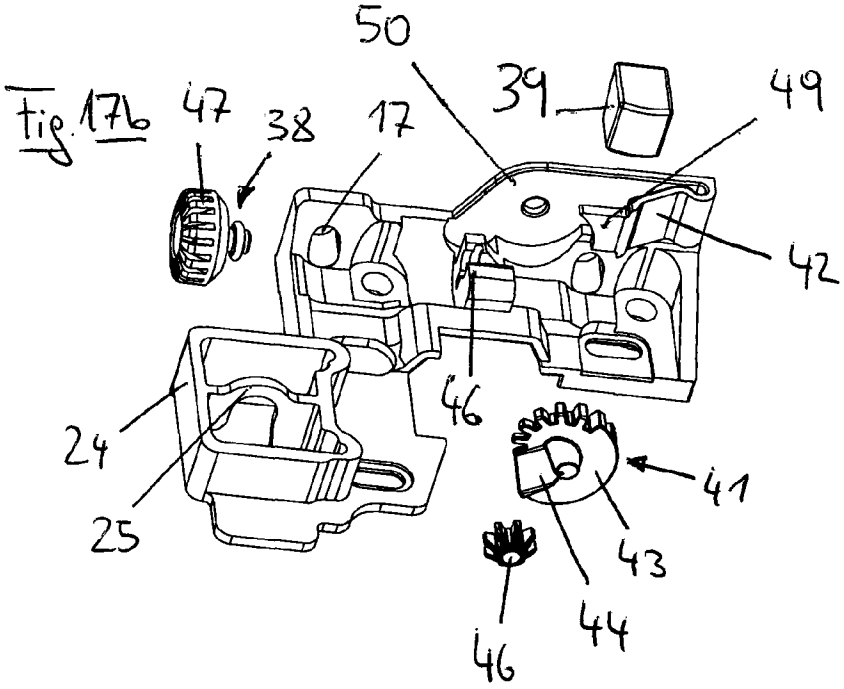

The exploded view in FIG. 17*b* shows the components of the fixing portion 9 and the device 5, that are essential for depth adjustment. It is possible to see the bevel gear 46 for transmission of the movement of the second adjusting wheel 38 to the gear 41.

The invention claimed is:

1. A coupling device for releasably coupling a drawer to a rail of an extension guide, said coupling device comprising:
- a fixing portion to be fixed to the drawer;
- a coupling portion to be coupled to the rail; and
- an adjusting device for adjusting a position of the drawer coupled to the rail relative to the rail within a plane parallel to a drawer bottom, said adjusting device being configured to linearly move said fixing portion relative to said coupling portion, said adjusting device including:
  - an adjusting wheel mounted rotatably to one of said coupling portion or said fixing portion so as to rotate about an axis of rotation, said adjusting wheel having a circumferential actuating region for allowing rotation of said adjusting wheel; and
  - a transmission device configured to convert a rotational movement of said adjusting wheel into a linear movement of said fixing portion relative to said coupling portion such that a position of the drawer relative to a furniture carcass is adjusted in a direction perpendicular to said axis of rotation.

2. The coupling device of claim 1, wherein said adjusting device is configured to adjust the position of the drawer coupled to the rail relative to the rail in a lateral direction of the extension guide, said axis of rotation of said adjusting wheel being substantially parallel to the extension direction of the drawer.

3. The coupling device of claim 1, wherein said adjusting device is configured to adjust the position of the drawer coupled to the rail relative to the rail in a longitudinal direction of the extension guide, said axis of rotation of said adjusting wheel is substantially horizontal and perpendicular to the extension direction of the drawer.

4. The coupling device of claim 1, wherein said transmission device is configured to convert a rotational movement of said actuating region of said adjusting wheel into a linear movement of said fixing portion relative to the coupling portion in the same direction as a tangential component of the rotational movement of said actuating region.

5. The coupling device of claim 1, further comprising an abutment element configured such that, in the closed position of the drawer, said abutment element is operatively connected to the extension guide or the furniture carcass, said adjusting device being configured to linearly move said abutment element to adjust the position of the drawer.

6. The coupling device of claim 5, wherein said abutment element is elastic, resilient, or spring-loaded.

7. The coupling device of claim 5, wherein said transmission device is configured to convert the rotational movement of said adjusting wheel into a linear movement of said abutment element in the direction of a tangential component of the rotational movement of said actuating region or in a direction opposite thereto.

8. The coupling device of claim 7, wherein said abutment element is mounted to said fixing portion, and said adjusting device is configured to move said abutment element relative to said fixing portion.

9. The coupling device of claim 8, wherein said adjusting device and said abutment element are configured to adjust a closed position of the drawer in a longitudinal direction of the extension guide by a movement of said abutment element.

10. The coupling device of claim 1, wherein said adjusting wheel is a first adjusting wheel, said adjusting device further including a second adjusting wheel, said first adjusting wheel being configured to adjust a position of the drawer relative to the rail in the lateral direction of the extension guide, and said second adjusting wheel being configured to adjust a position of the drawer relative to the rail in the longitudinal direction of the extension guide.

11. The coupling device of claim 1, wherein said transmission device is a first transmission device, said adjusting device having a second transmission device configured to convert a rotational movement of said adjusting wheel into a linear movement of said fixing portion relative to said coupling portion, said first transmission device and said second transmission device being spaced apart along said axis of rotation.

12. The coupling device of claim 11, wherein said adjusting wheel has two sides, each of said two sides engaging a respective one of said first transmission device and said second transmission device.

13. The coupling device of claim 12, wherein each of said two sides of said adjusting wheel is formed as a spiral disk engaging a respective one of said first transmission device and said second transmission device.

14. The coupling device of claim 11, wherein said adjusting wheel is rotatably mounted to said fixing portion, and said coupling portion has two lugs, each of said two lugs having a respective one of said first transmission device and said second transmission device thereon for converting a rotary movement of said adjusting wheel into a linear movement of said fixing portion relative to said coupling portion.

15. The coupling device of claim 11, wherein at least one of said first transmission device and said second transmission device is formed as toothed bars on one of said fixing portion or said coupling portion.

16. The coupling device of claim 11, wherein both said first transmission device and said second transmission device are formed as toothed bars on one of said fixing portion or said coupling portion.

17. The coupling device of claim 11, wherein said adjusting wheel includes two half portions non-rotatably connected together, each of said half portions being engaged with a respective one of said first transmission device and said second transmission device for converting the rotary movement of said adjusting wheel into a linear movement.

18. The coupling device of claim 1, wherein said transmission device comprises a spiral disk on a side of said adjusting wheel.

19. The coupling device of claim 1, wherein said transmission device has a gear.

20. The coupling device of claim 19, wherein said transmission device has a gear engaging an abutment element, said gear being rotatably mounted about an axis substantially parallel to a longitudinal direction of the extension guide.

21. The coupling device of claim 20, wherein said gear has an end face with a spiral configuration.

22. The coupling device of claim 1, wherein said adjusting device is self-locking.

23. The coupling device of claim 1, further comprising a housing portion having an opening through which said actuating region of said adjusting wheel projects to allow rotation of said adjusting wheel.

24. The coupling device of claim 1, wherein said transmission device has a bevel wheel.

25. A coupling device set for releasably coupling a drawer to extendable extension rails of an extension guide, the rails being arranged at opposite sides of a furniture carcass, said coupling device comprising:

a first coupling device comprising a coupling device as recited in claim 1 for releasably coupling the drawer to a first one of the extension rails; and a second coupling device comprising a coupling device as recited in claim 1 for releasably coupling the drawer to a second one of the extension rails.

26. A coupling device set for releasably coupling a drawer to extendable rails of an extension guide, the rails being arranged at opposite sides of a furniture carcass, said coupling device comprising:

a first coupling device comprising a coupling device as recited in claim 1 for releasably coupling the drawer to a first one of the extendable rails; and a second coupling device for releasably coupling the drawer to a second one of the extendable rails, said second coupling device including a second fixing portion to be fixed to the drawer and a second coupling portion to be coupled to the second one of the extendable rails, said second fixing portion and said second coupling portion being mounted movably relative to each other so as to conform to a relative shift in position of said fixing portion and said coupling portion of said first coupling device.

27. The coupling device set of claim 26, wherein said second coupling device further includes a second adjusting device for adjusting a position of the drawer relative to the second one of the extendable rails in a lateral direction of the extension guide, said second adjusting device including a second adjusting wheel rotatably mounted about a second axis of rotation on one of said second coupling portion or said second fixing portion for converting a rotational movement of said second adjusting wheel into a linear movement of said second fixing portion relative to said second coupling portion.

28. The coupling device set of claim 27, wherein said second axis of rotation is substantially parallel to an extension direction of the drawer, said second adjusting wheel including a second actuating region for allowing rotation of said second adjusting wheel, said second adjusting device further including a second transmission device for converting a rotational movement of said second actuating region into the linear movement of said second fixing portion relative to said second coupling portion in a direction of a tangential component of the rotational movement of said second actuating region.

29. The coupling device set of claim 27, wherein said second adjusting device has at least two second transmission devices axially spaced apart along said second axis of rotation for converting the rotational movement of said second adjusting wheel into the linear movement of said second fixing portion relative to said second coupling portion.

30. The coupling device set of claim 27, wherein said second adjusting device is self-locking.

31. A drawer comprising:

a drawer body having a front panel, side walls, a rear wall, and a drawer bottom;

an extension guide including a rail; and said coupling device as set forth in claim 1 releasably coupling said drawer body to said rail of said extension guide.

32. An article of furniture comprising:

a furniture carcass; and said drawer as set forth in claim 31 mounted in said furniture carcass.

* * * * *